US009764204B2

(12) United States Patent
Beach et al.

(10) Patent No.: US 9,764,204 B2
(45) **Date of Patent: *Sep. 19, 2017**

(54) CONTRAST-ENHANCED GOLF CLUB HEADS

(71) Applicant: Taylor Made Golf Company, Inc., Carlsbad, CA (US)

(72) Inventors: Todd P. Beach, Encinitas, CA (US); David Anderson, Hoffman Estates, IL (US); Bill Price, Santa Ana, CA (US); Kevin Harper, Fort Worth, TX (US); Benoit Vincent, Encinitas, CA (US); Bret H. Wahl, Escondido, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/302,817

(22) Filed: Jun. 12, 2014

(65) Prior Publication Data

US 2014/0295990 A1 Oct. 2, 2014

Related U.S. Application Data

(63) Continuation of application No. 13/051,973, filed on Mar. 18, 2011, now Pat. No. 8,771,095, and a (Continued)

(51) Int. Cl.

| | |
|---|---|
| ***A63B 69/36*** | (2006.01) |
| ***A63B 53/04*** | (2015.01) |
| *A63B 60/50* | (2015.01) |

(52) U.S. Cl.

CPC ..... *A63B 53/04* (2013.01); *A63B 53/0466* (2013.01); *A63B 53/0487* (2013.01); (Continued)

(58) Field of Classification Search

CPC . A63B 53/04; A63B 53/0466; A63B 53/0487; A63B 53/047; A63B 59/0088; (Continued)

(56) References Cited

U.S. PATENT DOCUMENTS

| | | | |
|---|---|---|---|
| 1,402,537 | A | 1/1922 | Reach |
| 1,660,126 | A | 2/1928 | Heeter |

(Continued)

FOREIGN PATENT DOCUMENTS

| | | |
|---|---|---|
| JP | 2001095956 | 4/2001 |
| JP | 2004209021 | 7/2004 |
| JP | 3148964 U | 3/2009 |

OTHER PUBLICATIONS

Globalgolf, "Taylor Made Rossa Corza Ghost Putter Golf Club," downloaded from http://www.globalgolf.com/product/golfclub/-/sku--1017311-aac/putter/taylor-made/rossa-corza-ghost.aspx?gd=1&utm_source=bingshopping&utm_medium=feed&utm_term=Taylor%20Made-Rossa%20Corza%20Ghost&utm_campaign=bingshopping, 1 p. (document not dated, downloaded on Feb. 3, 2011).

(Continued)

*Primary Examiner* — Sebastiano Passaniti

(74) *Attorney, Agent, or Firm* — Klarquist Sparkman, LLP

(57) ABSTRACT

Golf club heads include white diffusing top surfaces to aid in club head alignment. Wood type club heads also include a dark diffusing club face so that a crown/face border is emphasized. Scorelines in wood type clubs can be provided with an intermediate contrast surface, and can be displaced from club face center to accommodate player perception when confronted with a white diffusing crown. Putter heads can include dark diffusing alignment lines, and iron-type club heads can include white diffusing surfaces at a sole (Continued)

portion of a club face, at a top line, or a top portion of a club face.

18 Claims, 28 Drawing Sheets
(13 of 28 Drawing Sheet(s) Filed in Color)

Related U.S. Application Data continuation-in-part of application No. 29/376,895, filed on Oct. 13, 2010, now Pat. No. Des. 643,890, and a continuation-in-part of application No. 29/376,896, filed on Oct. 13, 2010, now Pat. No. Des. 643,891, and a continuation-in-part of application No. 29/376,897, filed on Oct. 13, 2010, now Pat. No. Des. 643,899, and a continuation-in-part of application No. 29/378,759, filed on Nov. 9, 2010, now Pat. No. Des. 643,894.

(60) Provisional application No. 61/428,593, filed on Dec. 30, 2010.

(52) U.S. Cl.
CPC ..... *A63B 53/047* (2013.01); *A63B 60/50* (2015.10); *A63B 2053/0416* (2013.01); *A63B 2053/0437* (2013.01); *A63B 2053/0441* (2013.01); *A63B 2207/02* (2013.01); *A63B 2209/00* (2013.01); *A63B 2209/02* (2013.01)

(58) Field of Classification Search
CPC ..... A63B 2053/0416; A63B 53/0441; A63B 2053/0437; A63B 2209/00; A63B 2209/02; A63B 2207/02; A63B 60/50
USPC ..... 473/324–350, 287–292, 219–256; D21/736–746, 733, 752, 759
See application file for complete search history.

(56) References Cited

U.S. PATENT DOCUMENTS

D97,418 S 11/1935 Smith
D149,156 S * 3/1948 Weatherington ..... 473/251
2,534,947 A 12/1950 Bright
2,865,635 A 12/1958 Jessen
2,954,231 A 9/1960 MacIntyre
D220,274 S 3/1971 Rango
3,649,029 A * 3/1972 Worrell ..... A63B 69/36 2/245
3,708,172 A 1/1973 Rango
3,749,408 A 7/1973 Mills
D231,624 S 5/1974 Wilmoth
3,909,005 A 9/1975 Piszel
D237,289 S 10/1975 Calton
3,954,265 A 5/1976 Taylor
D245,442 S 8/1977 Becker
D268,691 S 4/1983 Collins
4,753,440 A 6/1988 Chorne
4,960,279 A 10/1990 Harris, Jr.
4,962,931 A 10/1990 Jazdzyk, Jr.
5,072,941 A * 12/1991 Klein ..... A63B 53/0487 473/255
5,190,289 A 3/1993 Nagai et al.
5,242,344 A 9/1993 Hundley
D352,758 S 11/1994 Tate
5,470,072 A 11/1995 Cunningham
5,529,299 A 6/1996 Bellagamba
D378,392 S 3/1997 Shumway
D378,844 S 4/1997 Shine
D380,030 S 6/1997 Altman
D384,120 S 9/1997 De La Cruz et al.
5,676,603 A 10/1997 Miller
D388,853 S 1/1998 Minami
D389,885 S 1/1998 Mahaffey et al.
5,720,668 A 2/1998 Brett
5,769,740 A 6/1998 Colangelo
D402,724 S 12/1998 Minami
6,024,650 A 2/2000 Reeves
D422,664 S 4/2000 Tate
D424,145 S 5/2000 Minami
6,149,531 A 11/2000 Hooker
D453,365 S 2/2002 Carr et al.
6,425,831 B1 7/2002 Heene et al.
D461,513 S 8/2002 Madore et al.
D461,862 S 8/2002 Madore et al.
6,471,600 B2 10/2002 Tang et al.
D466,173 S 11/2002 Sizemore, Jr.
6,506,125 B2 1/2003 Helmstetter et al.
D478,948 S 8/2003 Bergling-Olson
D485,880 S 1/2004 Madore et al.
6,676,535 B2 1/2004 Sheets et al.
D490,487 S 5/2004 Burrows
D503,762 S 4/2005 Wood
D518,864 S 4/2006 Bradshaw
7,022,030 B2 4/2006 Best et al.
D527,064 S 8/2006 Breier et al.
7,172,519 B2 2/2007 Byrne et al.
D537,895 S 3/2007 Breier et al.
7,235,021 B2 6/2007 Solheim et al.
7,264,558 B2 9/2007 Kubica et al.
D553,210 S 10/2007 Harvell et al.
D553,211 S 10/2007 Harvell et al.
7,344,451 B2 3/2008 Tang et al.
D568,427 S 5/2008 Nguyen et al.
D572,325 S 7/2008 Baer
7,396,289 B2 7/2008 Soracco et al.
D577,405 S 9/2008 Oldknow et al.
D583,431 S 12/2008 Madore et al.
7,481,715 B2 1/2009 Byrne
7,491,135 B1 2/2009 Rollinson
D591,812 S 5/2009 Breier et al.
D596,691 S 7/2009 Heap
7,588,499 B2 9/2009 Tateno
D607,952 S 1/2010 Demkowski et al.
D618,294 S 6/2010 Morris et al.
D631,928 S 2/2011 Piatkowski
D643,890 S 8/2011 Piniarski et al.
D643,891 S 8/2011 Piniarski et al.
D643,894 S 8/2011 Price et al.
D643,899 S 8/2011 Piniarski et al.
8,025,589 B2 9/2011 Brinton et al.
8,771,095 B2 * 7/2014 Beach et al. ..... 473/226
9,468,817 B2 * 10/2016 Beach ..... A63B 53/04
2005/0130755 A1 6/2005 Lindsay
2005/0164800 A1 7/2005 Wood et al.
2005/0272522 A1 12/2005 Chen et al.
2007/0155537 A1 * 7/2007 Morris ..... A63B 53/0487 473/340
2008/0076598 A1 3/2008 Lin
2009/0017933 A1 1/2009 Stites et al.
2009/0017934 A1 1/2009 Stites et al.
2009/0215547 A1 8/2009 Hegarty
2009/0314398 A1 12/2009 Shaar, Jr.
2010/0304878 A1 * 12/2010 Reichow ..... A63B 53/007 473/251
2012/0083354 A1 4/2012 Bertone et al.
2014/0113736 A1 * 4/2014 Dill ..... A63B 53/0487 473/242

OTHER PUBLICATIONS

Tour Stop, "TaylorMade Putter Daytona #1 Ghost Right Hand," http://www.tourstop.com/istar.asp?a=6&id=DAYTONAGHOST1RH%2116432&utm_source=VersaFeed&utm_medium=VersaFeed_bing&utm_content=TaylorMade+Putter+Daytona+1+Ghost+Right+Hand+White+35_inches&utm_campaign=cashback&v_traceback=c0118_2321_f0128_1833, 1p. (document not dated, downloaded on Feb. 3, 2011).

(56) References Cited

OTHER PUBLICATIONS

Cobragolf, "Limited Edition ZL Driver," http://www.cobragolf.com/golf-clubs/Cobra-White-ZL-Driver, 3pp. (document not dated, downloaded on Feb. 3, 2011).
About.com Golf, "Cobra Offers All-White ZL Driver—But Only 500 of Them," http://golf.about.com/b/2010/11/05/cobra-offers-all-white-zl-driver-but-only-500-of-them.htm, 1p. (document marked Nov. 5, 2010, downloaded on Feb. 3, 2011).
Golf Digest, "How to Play Fearless Golf," http://golfdigest.com (Mar. 2011).

* cited by examiner

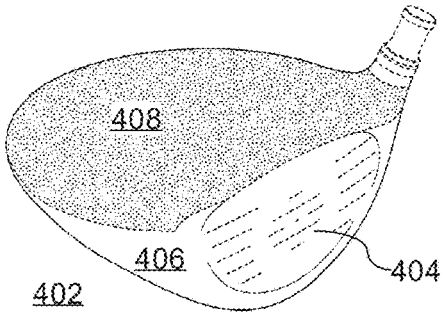
FIG. 4A
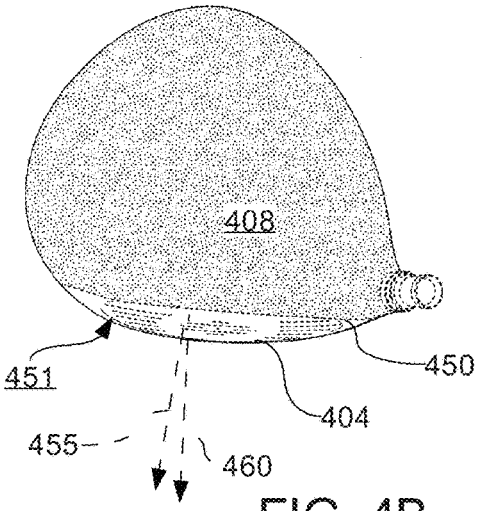
FIG. 4B
FIG. 4C
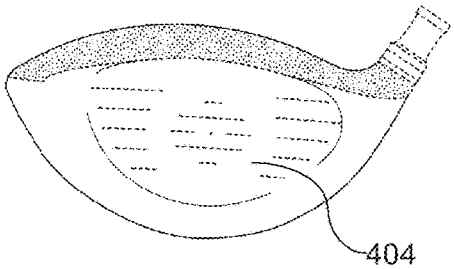
FIG. 4D
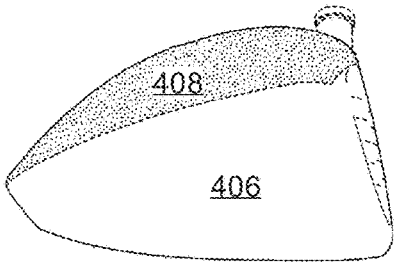
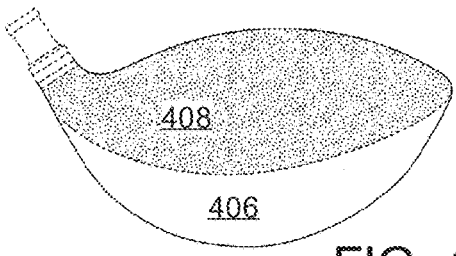
FIG. 4E
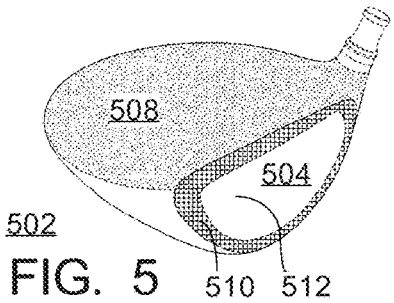
FIG. 5

CONTRAST-ENHANCED GOLF CLUB HEADS

CROSS REFERENCE TO RELATED APPLICATIONS

This application claims the benefit of U.S. Provisional Patent Application No. 61/428,593, filed Dec. 30, 2010, and is a continuation of U.S. application Ser. No. 13/051,973, filed Mar. 18, 2011, which is a continuation in part of U.S. Design application Nos. 29/376,895, filed Oct. 13, 2010; 29/376,896, filed Oct. 13, 2010; 29/376,897, filed Oct. 13, 2010; and 29/378,759, filed Nov. 9, 2010, all of which are incorporated herein by reference.

BACKGROUND

Golf club design has increasingly relied on sophisticated materials and manufacturing processes that permit club designs to precisely target club mechanical properties. For example, perimeter weighted iron type club designs provide large sweet spots that substantially reduce the adverse consequences of off-center hits. Designers can place club head mass so as provide a desired center of mass or moment of inertia to provide a preferred ball launch angle or to provide forgiveness with respect to off-center hits.

Clubs are commonly fitted to players so that the benefits associated with these sophisticated designs can be achieved for players of all skill levels. Thus, golfers can choose from a variety of designs that offer broad ranges of capabilities, select designs appropriate for their individual needs, and individualize clubs with respect to loft and lie angles, shaft lengths, and shaft flex.

Although club mechanical properties have been significantly improved, other club characteristics have not seen similar advances. The ball striking required at all skill levels in golf involves precise hand-eye coordination. If a player is unable to accurately and repeatedly align club and ball, the features provided by modern club designs can improve performance, but not eliminate the consequences of mishits. Thus, new approaches that permit more accurate and repeatable alignment are needed.

SUMMARY

In some examples, golf club heads comprise a crown having at least an upward facing surface portion provided with a diffused surface treatment as viewed from an address orientation, wherein the diffused surface treatment defines a highest reflected intensity location on the crown in response to illumination from a light source situated within a cone of angular radius of about 30 degrees above the crown and a secondary location situated on the crown at a distance of at least 20% of a crown effective length from the highest reflected intensity location having a reflected intensity of at least 25% of the highest reflected intensity. The golf club head also includes a striking surface situated so as to define an interface with the crown. In some embodiments, the crown effective length is selected from a plurality of pixel radii having a 30 degree angular spacing and radiating from the highest reflected intensity location to an edge of the crown. In other examples, the crown effective length is associated with a toe-to-heel direction, a direction perpendicular thereto, or an angle that is an integer multiple of 5 degrees with respect to the toe-to-heel direction. In still other examples, a zone of crown intensity is defined from the crown effective length in a direction of 30 degrees and negative 30 degrees from the crown effective length orientation, wherein the reflected intensity is at least 20% of the highest reflected intensity within a distance of at least 20%, 40%, or 60% of the crown effective length from the highest reflected intensity location. In representative examples, the secondary location is situated on the crown at a distance of at least 30%, 40%, 50%, or 60% of the crown effective length from the highest reflected intensity location.

In some example embodiments, a plurality of secondary locations are situated on the crown at distances of at least 50% of the crown effective length along a respective plurality of pixel radii situated at angles of at least 30 degrees with respect to each other such that the secondary locations are situated on the crown a distance of at least 50% of a respective pixel radius and are associated with reflected intensities of at least 50% of the highest reflected intensity. In some particular examples, the secondary locations are situated on the crown a distance of at least 75% of the respective pixel radii and are associated with reflected intensities of at least 70% of the highest reflected intensity. In other representative examples, the diffused surface treatment is a white surface treatment associated with a gloss value of less than about 60.

In some embodiments, a transparent matte coating is situated on at least the upward facing portion of the crown, wherein the transparent matte surface is a semigloss or low gloss surface. In typical examples, the transparent matte coating has a gloss value of less than 60 gloss units. In other examples, at least the upward facing portion of the crown surface has a chroma value of less than 5 and at least a top portion of the face surface adjacent the crown has a black surface treatment. In representative examples, at least the top portion of the face surface has a gloss value of less than 50 gloss units, or the black surface treatment has a chroma of less than one and a brightness of less than 50. In additional examples, the face surface has a black surface treatment having a chroma of less than 1.0 and a brightness of less than 50, and at least the upward facing portion of the crown surface has a chroma value of less than 5 and a brightness greater than 85.

Metal wood-type golf club heads include a body comprising a face plate positioned at a forward portion of the golf club head, a sole positioned at a bottom portion of the golf club head, a crown positioned at a top portion of the golf club head and a skirt positioned around a periphery of the golf club head between the sole and the crown. The head has a golf club head origin positioned on the face plate at an approximate geometric center of the face plate, the head origin including an x-axis tangential to the face plate and generally parallel to the ground when the head is in an address position, a y-axis generally perpendicular to the x-axis and generally parallel to the ground when the head is in an address position, and a z-axis generally perpendicular to the x-axis and to the y-axis and generally perpendicular to the ground when the head is in an address position. A positive x-axis extends toward a club head heel, a positive y-axis extends toward the cavity, and a positive z-axis extends away from the ground with the head in the address position. At least a perimeter portion of the crown adjacent a top portion of the faceplate and having an area that is at least 5% of the crown area has a bright, diffusely reflecting surface, and at least a top perimeter portion of the face plate has a dark diffusely reflecting surface area. In some embodiments, the bright, diffusely reflecting portion of the crown is white and includes at least the upper facing portion of the crown, and the face plate surface is a dark diffusely reflecting surface. In other examples, the bright, diffusely reflecting portion of the crown has a chroma value of less than 5, and the face plate surface has a chroma value of less than 1. In additional representative examples, the bright, diffusely reflecting portion of the crown has a brightness of at least 80.

In some examples, at least a portion of the crown adjacent a top perimeter of the face plate has a semigloss surface with a chroma value of less than 10 and a brightness of at least 50. In other examples, the bright diffusely reflecting surface extends over at least 80% of the upward facing crown area or the crown surface has a CIELab brightness of between 50 and 100, and a gloss value of less than 60 gloss units. In still further examples, the dark, diffusively reflecting face plate surface area has a CIELab brightness of less than 40 and a chroma of less than 10 or the face plate has a gloss value of less than 60 gloss units. In other examples, a difference in L* values between the crown and the face is high contrast for more than about 14.3%, 28.6%, 42.9%, 57.1%, 71.4%, or 85.7% of the face distance.

Putter heads comprise a crown having at least an upward facing surface portion provided with a white diffusing surface treatment as viewed from an address orientation, and a striking face that includes a dark surface portion. In some examples, the crown has a CIELab L* value of between 50 and 100, a chroma of less than 2, a hue of between 235 degrees and 270 degrees. The white diffusing surface treatment extends over at least 90% of the upward facing surface portion and has a gloss that is less than 60 gloss units. In other examples, the crown has a CIELab L* value of between 64 and 93, a chroma of less than 4, and the white diffusing surface treatment extends over at least 80% of the upward facing surface portion and is a semigloss surface treatment. In still further embodiments, the crown has a CIELab L* value of between 88 and 93, a chroma of between 3 and 4, a hue between 215 and 235, and the white diffusing surface treatment extends over at least 60% of the upward facing surface portion and is a semigloss surface treatment.

In other embodiments, golf club heads comprise a crown having at least an upward facing surface portion provided with a diffused surface treatment as viewed from an address orientation, wherein the white surface treatment defines a highest reflected intensity location on the crown in response to illumination from a light source situated within a cone of angular radius of about 30 degrees above the crown. A secondary location situated on the crown a distance of at least 50% of a crown effective length from the highest reflected intensity location has a reflected intensity of at least 25% of the highest reflected intensity. A striking surface is situated so as to define an interface with the crown. In some examples, the secondary location is situated on the crown a distance of at least 20%, 30%, 40%, 60%, 75%, or 85% of the crown effective length from the highest reflected intensity location, and has a reflected intensity of at least 50% or 70% of the highest reflected intensity.

In some examples, a plurality of secondary locations are situated on the crown at distances of at least 50% of a pixel radius along a respective plurality of pixel radii situated at angles of at least 30 degrees with respect to each other such that the secondary locations are situated on the crown a distance of at least 50% of a respective crown effective length from the highest intensity location and are associated with reflected intensities of at least 50% of the highest reflected intensity. In some examples, the white surface treatment defines a semigloss surface that is associated with a gloss value of less than about 60 or 40.

In additional examples, a transparent matte coating is situated on at least the upward facing portion of the crown, wherein the transparent matte surface is a semigloss or low gloss surface, having a gloss value of less than 60 gloss units. In some alternatives, at least the upward facing portion of the crown surface has a chroma value of less than 5 or less than 2. In still other examples, at least a top portion of the face surface adjacent the crown has a black surface treatment that is a semigloss or low gloss surface. In some examples, the face surface has a gloss value of less than 60, 50, or 40 gloss units. In particular examples, the black surface treatment has a chroma of less than 1 or 0.9 and a brightness of less than 50 or 30. In some embodiments, the face surface has a black surface treatment having a chroma of less than 1.0 and a brightness of less than 50, and at least the upward facing portion of the crown surface has a chroma value of less than 5 and a brightness greater than 85.

In some examples, metal wood-type golf club heads comprise a body comprising a face plate positioned at a forward portion of the golf club head, a sole positioned at a bottom portion of the golf club head, a crown positioned at a top portion of the golf club head and a skirt positioned around a periphery of the golf club head between the sole and the crown. The head has a golf club head origin positioned on the face plate at an approximate geometric center of the face plate. The head origin includes an x-axis tangential to the face plate and generally parallel to the ground when the head is in an address position, a y-axis generally perpendicular to the x-axis and generally parallel to the ground when the head is in an address position, and a z-axis generally perpendicular to the x-axis and to the y-axis and generally perpendicular to the ground when the head is in an address position, wherein a positive x-axis extends toward a club head heel, a positive y-axis extends toward the cavity, and a positive z-axis extends away from the ground with the head in the address position. At least a perimeter portion of the crown adjacent a top portion of the faceplate and having an area that is at least 5% of the crown area has a bright, diffusely reflecting white surface, and at least a top perimeter portion of the face plate has a dark diffusely reflecting surface area. In other examples, the face plate comprises a plurality of scorelines, wherein the scorelines include a diffusely reflecting surface area that has an intermediate value of reflectance between that of the bright, diffusely reflecting portion of the crown and the dark portion of the face plate. In other embodiments, the bright, diffusely white reflecting portion of the crown includes at least the upper facing portion of the crown, and the face plate surface is a dark diffusely reflecting surface. In representative implementations, the bright, diffusely reflecting portion of the crown has a chroma value of less than 5, and the face plate surface has a chroma value of less than 1. In still further examples, the bright, diffusely reflecting white portion of the crown has a brightness of at least 80 and less than 100. Typically, at least a portion of the crown adjacent a top perimeter of the face plate has a semigloss surface with a chroma value of less than 10 and a brightness of at least 50.

In some example embodiments, least a portion of the crown adjacent a top perimeter of the face plate has a semigloss surface with a chroma value of less than 6 and a lightness of at least 75 or at least a portion of the crown adjacent a top perimeter of the face plate has a semigloss surface with a chroma value of less than 4 and a lightness of at least 90. In at least some embodiments, the bright diffusely reflecting surface extends over at least 80% of the upward facing crown area. In other examples, the crown surface has a CIELab brightness of between 50 and 100, and a gloss value of less than 60 gloss units. In typical examples, the dark, diffusively reflecting face plate surface area has a CIELab brightness of less than 30 or 40, a chroma of less than 5 or 10, and a gloss value of less than 60 gloss units.

Putter heads comprise a crown having at least an upward facing surface portion provided with a white diffusing surface treatment as viewed from an address orientation. A central alignment index is situated on the crown and extends so as to be perpendicular to a striking surface, the central alignment index provided with a black diffusing surface treatment. At least one aperture is defined in a club body and situated behind the striking surface as viewed from the address orientation, wherein the aperture is symmetrically situated with respect to the central alignment index. In some examples, the white diffusing surface treatment has a gloss of less than 60 gloss units, and a CIE hue value that is between 250 degrees and 320 degrees. In other examples, the white diffusing surface treatment extends over at least 85% of the upward facing surface portion and the central alignment index comprises a groove extending to the striking surface and the black diffusing surface is situated within the groove. In additional examples, a dark striking surface is provided having a CIE L* values of less than 50.

These and other features and aspects of the claimed technology are set forth below with reference to the accompanying drawings.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

FIGS. 4A-4E are views of a driver-type golf club head according to a representative embodiment.

FIG. 5 is a perspective view of a wood-type golf club as viewed from a top, one side, according to a representative embodiment.

DETAILED DESCRIPTION

Figure 1A:
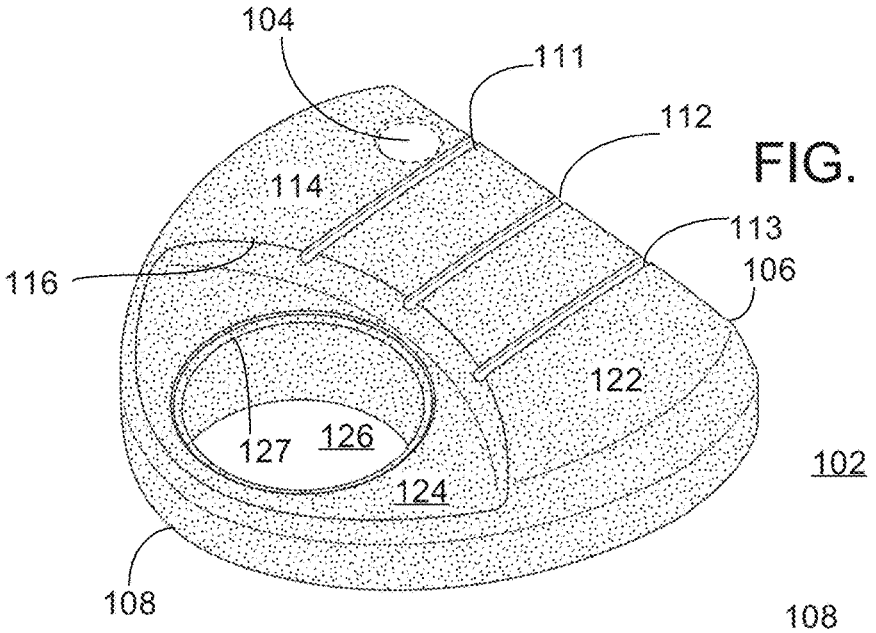
FIG. 1A is a perspective view of a mallet-type high visibility putter, as viewed from the rear, one side.

As used in this application and in the claims, the singular forms "a," "an," and "the" include the plural forms unless the context clearly dictates otherwise. Additionally, the term "includes" means "comprises." Further, the term "coupled" does not exclude the presence of intermediate elements between the coupled items.

The clubs and club heads described herein should not be construed as limiting in any way. Instead, the present disclosure is directed toward all novel and non-obvious features and aspects of the various disclosed embodiments, alone and in various combinations and sub-combinations with one another. The disclosed club heads are not limited to any specific aspect or feature or combinations thereof, nor do the disclosed club heads require that any one or more specific advantages be present or problems be solved. Any theories of operation are to facilitate explanation, but the disclosed club heads are not limited to such theories of operation.

Typical examples are described below that include bright white diffusing top surfaces that are more readily perceived by a golfer. In addition, such top surfaces produce an appearance of increased size, promoting golfer confidence. By providing a contrasting club face, the face/crown interface that is used for club alignment becomes more visually apparent.

Examples of wood type and iron type golf clubs and club heads are provided below. In addition, examples of putters and putter heads are provided. For convenient description, standard golf illumination is defined herein as illumination associated with common outdoor playing conditions in natural lighting, i.e., full sun, partial sun, partial shade, full shade, and overcast conditions at times a few hours after sunrise and a few hours before sunset. Golf club and club head features are described with reference to a club head position at an address position, i.e., a customary position from which a golfer initiates a swing sequence. For convenience, if needed, directions are referenced to an address position for a right handed golfer addressing a right handed club. A rearward direction is a direction from a striking surface opposite an intended line of ball flight. An upward direction is a direction upward from a playing surface.

Metal wood clubs as described herein can have bare metallic striking or other surface. Textured surfaces can be provided with a texture finish such as a tumble finish or sand blasted finish. Coatings can be applied to striking faces, and a durable coating such as produced with plasma vapor deposition (PVD) or ion plating (IP) is preferred, as paint can chip after use and may cause spin degradation. Clubs can have titanium alloy (Ti) faces or steel alloy (Steel), or other faces. The range of ion plating finish colors available to coat these faces is limited. One face coating for Ti or steel (and more durable than some other colors) is a black IP finish. Crown paints are available in a large variety of colors.

With reference to FIGS. 1A-1E, a putter includes a putter head 102 and a shaft mounting bore 104 provided in the putter head 102 for attachment of a putter shaft. The putter head 102 has a shape that can be referred to as a mallet type as the putter head 102 has a substantial depth from a putter striking face 106 to a backmost surface 108. This configuration permits the putter head 102 to have a relatively larger putter head mass and a larger moment of inertia than so-called blade type putter heads. Another benefit of the putter head 102 having a larger head would be to set the center of gravity location farther back for improved roll or launch performance upon impact with the ball. The putter head 102 includes a series of alignment indices 111, 112, 113 situated on a top or crown surface 114 and extending substantially perpendicularly from about the putter striking face 106 to a rear arc 116. The alignment index 112 (the central alignment index) is substantially aligned with a geometrical center of a striking surface 120 situated on the putter striking face 106 of the putter head 102. In some examples, the striking face 106 is provided with an insert 120 that is secured to the putter head in a recess provided in the putter head 102.

The rear arc 116 corresponds to a boundary between a first portion 122 of the putter head 102 having a full thickness, and a stepped down portion 124. The indices 111, 112, 113 noted above promote visual alignment but occupy less that about 5,%, 6%, 7%, 8%, or 10% of the surface area of the first portion 122 which is typically covered with a white diffusively reflecting surface treatment. The stepped down portion includes a circular aperture 126 having a radius that is between about 0.8 and 1.2 times a golf ball diameter, 0.9 and 1.1 times a golf ball diameter, or 0.95 and 1.05 times a golf ball diameter. Typically, the diameter of the aperture 126 is selected to be approximately equal to a golf ball diameter. In some examples, a golf ball diameter is about 41.67 mm. In other examples, the aperture 126 has a diameter of between about 20 mm and 75 mm, 30 mm and about 60 mm, 36 mm and about 44 mm, or 38 mm and about 41 mm. A partial cylindrical bore 127 is situated about the aperture 126 and can have a diameter that is between about 0.1 mm and 5 mm greater that the diameter of the aperture 126. The partial bore 127 typically has a depth of between 0.1 mm and 5 mm. The aperture 126 and the bore 127 are generally circular, but other shapes can be used, but situated so as to be symmetric about the central alignment index 112 to facilitate alignment of the club head. In addition, the rear arc 116 is situated so as to be bisected by the central alignment index 112. The putter head 102 also has a perimeter that is symmetric with respect to the central alignment index 112, but perimeter symmetry can be adjusted to provide apparent symmetry when the putter head 102 is viewed in address position as shaft attachment or other putter features can provide apparent distortion. As shown in FIG. 1C, a bottom portion of the putter head 102 can have relief regions 130, 131 that can have a different surface finish than other portions of the putter head.

Because putting (as well as other golf strokes) requires precise alignment, the putter head 102 is provided with suitable surface treatments to promote visibility and alignment. In one example (and as shown in FIGS. 1A-1E), the putter head 102 is substantially provided with a diffusing, white surface treatment. Such a surface treatment provides superior visibility with respect to the common putting surface backgrounds with which a putter is used. With such a surface treatment, the putter head 102 appears substantially brighter than a putting surface and putting surface color provides an additional contrast with respect to a neutral white surface. Not only does a diffusing white surface treatment provide superior visibility with respect to a putting surface, such a diffusing surface reduces or eliminates specular reflections of the sun that are responsible for glare or bright spots experienced by a golfer when using a putter. The combination of increased apparent brightness of a putter head due to white surface treatment and diminished specular reflectance due to the diffusing surface substantially reduces distracting glare.

A diffused surface treatment is defined as a surface treatment applied to a club head base material to change the color or glossiness of the surface so as to control, reduce, or minimize any glare spots located on the crown of the golf club head. Diffused surface treatments include coatings located on top of the base material of the club head. In some embodiments, the diffuse surface treatment is a white color. Examples of diffuse surface treatments include paints, matte clear coats, clear coats, powder coatings, PVD, CVD, platings, ion platings, electroplatings, ceramic coatings.

Examples of paints include urethane base coatings, pearl coats, epoxy based coatings, decals, inks, and primer coatings.

While providing a diffusing white surface for a putter head top surface is beneficial, such a surface is preferably used in conjunction with alignment indices that are provided with a surface treatment that establishes a dark, highly diffusing surface. In one embodiment, the putter can include a first primer layer being 50 μm thick, a second paint layer being about 85 μm thick, and a clear coat being about 115 μm thick. In one embodiment, the clear coat layer is thicker than the other individual layers. For example, a glossy black surface treatment tends to exacerbate visibility problems when used with a light colored top surface, because the absence (or reduction) in glare elsewhere on the top surface causes attention to be undesirably brought to specular reflections associated with alignment indices such as the alignment indices 111, 112, 113. Thus, a white or neutral diffusing top surface is preferably accompanied with a diffusing surface treatment for alignment indices.

The putter head 102 of FIGS. 1A-1E includes a plurality of alignment features that aid in alignment in addition to an enhanced contrast top surface and alignment indices with reduced specular reflectance. The aperture 126 (and the partial bore 127), alignment indices 111, 112, 113, the rear arc 116, as well as the overall shape of the putter head are configured so that the golfer receives numerous apparent visual cues as to putter head alignment. In other examples, at least some of these features are omitted to provide greater design flexibility.

Surface treatments can be provided by applying a diffusing white paint to a club head, typically over a gray or other non-white primer coat. Alignment indices can be formed as grooves in the putter head 102 that are then partially filed with a black diffusing material such as a flat black paint. Because the putter striking face 106 is not visible (or barely visible) to a golfer, the striking face 106 can be configured as desired. Alternatively, the surfaces of the striking face can be partially or completely treated as indicated above. In addition, putter faces can be visible based on the degree loft in the putter head. In preferred embodiments, the face has a high contrast to the remaining club color for alignment purposes. In one embodiment, the face is a black or dark color aiding in alignment while also minimizing the amount of color reflection created on the ball at the address position.

Figure 2A:
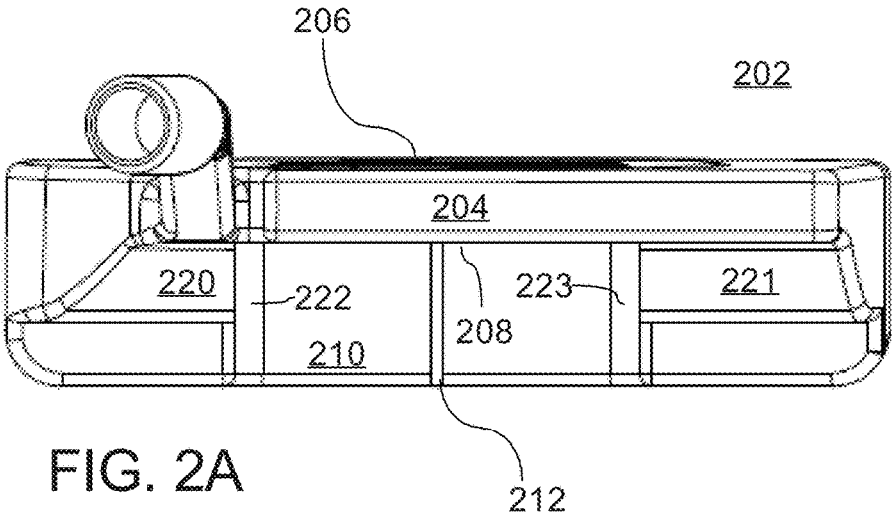
FIG. 2A is a top plan view of a one example of a high visibility putter head.
Figure 2B:
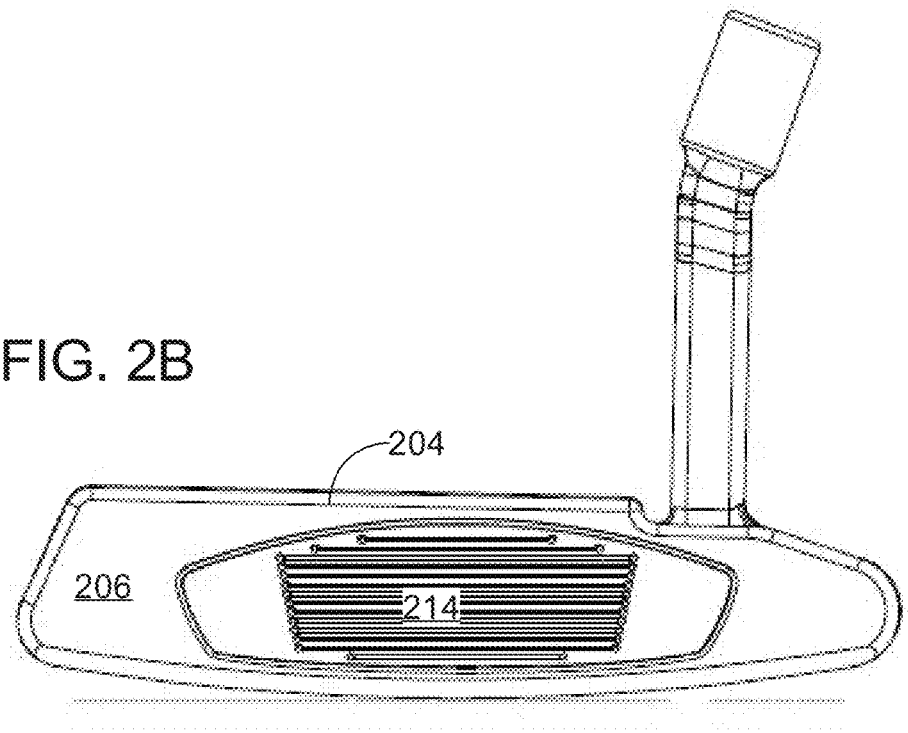
FIG. 2B is a front elevational view of the putter head of FIG. 2A.

An alternative putter head 202 is illustrated in FIGS. 2A-2B. The putter head 202 is a modified blade-type design that includes a blade 204 that includes a striking surface 206 and a rear surface 208. The blade 204 extends upwardly from a sole 210 that is provided with an alignment index 212 that extends from a rear surface of the sole 210 to the rear surface 208 of the blade 204. An insert 214 is provided in the striking surface 206 to provide a striking area. The alignment index 212 is generally aligned perpendicular to and centered on the striking surface. Shoulders 220, 221 extend upwardly from the sole 210 and are coupled to or unitary with the blade 204, and permit mass to be distributed away from the center of the striking surface so as to increase moment of inertia. The shoulders 220, 221 can be made of a more dense material than other portions of the putter head 202, or can be provided with bores or other relieved volumes configured to receive additional weights. Inner surfaces 222, 223 of the shoulders 220, 221 are generally situated so as to provide a separation corresponding to a golf ball diameter. Typically, the separation is between about 0.8 and 1.2 times a golf ball diameter, 0.9 and 1.1 times a golf ball diameter, or 0.95 and 1.05 times a golf ball diameter. In some examples, a golf ball diameter is about 41.67 mm. In other examples, the separation is between about 30 mm and 75 mm, about 35 mm and about 60 mm, about 36 mm and about 44 mm, or about 38 mm and about 41 mm. To promote alignment and visibility, at least some portions of the putter body 202 are provided with a suitable surface appearance. For example, upward facing portions of the putter head 202 can be provided with a diffuse, white appearing coating or other surface treatment as described above. In addition, the alignment index 212 can be provided with a dark, diffusing coating.

As used herein, a white reflecting surface is a surface that reflects at least about 50%, 60%, 70%, 80%, 85%, 90%, 95%, or 97% of an incident light flux corresponding to full sun, partial sun, partial shade, or shade daylight conditions or daylight cloud cover conditions. Such reflectances are such that the apparent color of the resulting reflected light is not appreciably different from that of the incident light flux. Reflectance for colored surfaces can be similarly defined. For example, a red surface is a surface that that reflects at least about 50%, 60%, 70%, 80%, or 85% of a red portion of incident light flux corresponding to full sun, partial sun, partial shade, shade daylight conditions, or daylight cloud cover conditions. An effective diffusing surface as used herein is a surface for which a ratio of luminous intensity produced by the diffusing surface with respect to a luminous intensity of a perfect (Lambertian) diffuser in response to illumination at normal incidence to the diffusing surface is at least 0.2, 0.4, 0.6, 0.8, or 0.9 at an angle of 20 degrees, 30 degrees, 40 degrees, or 45 degrees. As used herein, effective diffusing surfaces can be characterized with an effective diffusing ratio corresponding to the above ratios and a related diffusing angle. Contrasting surfaces can be provided based on total reflectance of less than 20%, 10%, or 5% of an incident light flux corresponding to full sun, partial sun, partial shade, shaded, or daylight cloud cover conditions.

While white appearing surface treatments can provide the greatest reflectances, off-white, eggshell white, and red, green, yellow, or other colors or tinted whites can be used. In some cases, whites corresponding to golf ball appearances are used, and can include brightening agents. In some examples, color contrast can be provided between club head features and a playing surface to increase contrast, but the examples below are described with reference to white or other almost color neutral surface treatments. For example, red surface portions can be contrasted with cyan surface portions, green surface portions with magenta surface portions, and blue surface portion with yellow surface portions, but other color combinations can be used. In addition, while selected portions of a club head can be provided with a selected contrast enhancing (or specular reflection reducing) surface treatment, such treatments can be provided as solid treatments that cover an entire surface portion, or stippling or patterns such as checks, stripes, or other periodic or aperiodic arrangements. Finally, neutral grays or darker colors can be used in which reflectances are less than those listed above. In some examples, only surface areas at or near selected club head edges are provided with white or other contrast enhancing or diffusing surface treatments.

Other types of golf clubs can be configured similarly. Referring to FIGS. 3A-3D, characteristics of wood type golf clubs such as drivers, fairway woods, and rescues are shown by way of reference to a golf club head 300 having a removable shaft 50. The club head 300 comprises a centerface, or striking face, 310, scorelines 320, a hosel 330 having a hosel opening 340, and a sole 350. The hosel 330 has a hosel longitudinal axis 60 and the shaft 50 has a shaft longitudinal axis. In the illustrated embodiment, the ideal impact location 312 of the golf club head 300 is disposed at the geometric center of the striking surface 310 (see FIG. 3A). The ideal impact location 312 is typically defined as the intersection of the midpoints of a height ($H_{ss}$) and width ($W_{ss}$) of the striking surface 310.

Figure 3A:
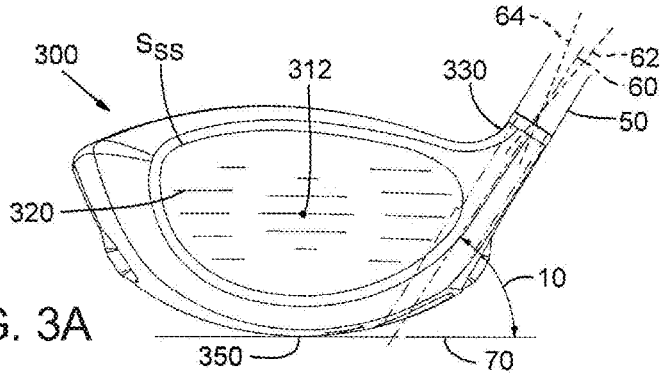
FIG. 3A is a front elevational view of a golf club head in accordance with one embodiment.

As shown in FIG. 3A, a lie angle 10 (also referred to as the "scoreline lie angle") is defined as the angle between the hosel longitudinal axis 60 and a playing surface 70 when the club is in the grounded address position. The grounded address position is defined as the resting position of the head on the playing surface when the shaft is supported at the grip (free to rotate about its axis) and the shaft is held at an angle to the ground such that the scorelines 320 are horizontal (if the club does not have scorelines, then the lie shall be set at 60-degrees). The centerface target line vector is defined as a horizontal vector which is perpendicular to the shaft when the club is in the address position and points outward from the centerface point. The target line plane is defined as a vertical plane which contains the centerface target line vector. The square face address position is defined as the head position when the sole is lifted off the ground, and the shaft is held (both positionally and rotationally) such that the scorelines are horizontal and the centerface normal vector completely lies in the target line plane (if the head has no scorelines, then the shaft shall be held at 60-degrees relative to ground and then the head rotated about the shaft axis until the centerface normal vector completely lies in the target line plane). The actual, or measured, lie angle can be defined as the angle 10 between the hosel longitudinal axis 60 and the playing surface 70, whether or not the club is held in the grounded address position with the scorelines horizontal. Studies have shown that most golfers address the ball with actual lie angle that is 10 to 20 degrees less than the intended scoreline lie angle 10 of the club. Studies have also shown that for most golfers the actual lie angle at impact is between 0 and 10 degrees less than the intended scoreline lie angle 10 of the club.

Figure 3B:
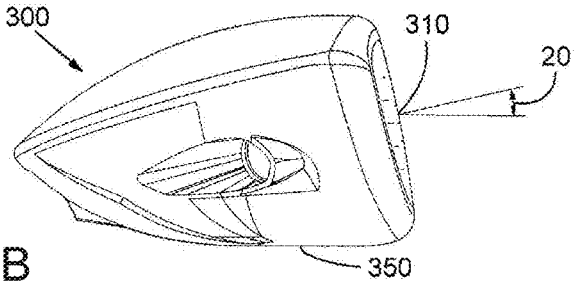
FIG. 3B is a side elevational view of the golf club head of FIG. 3A.

As shown in FIG. 3B, a loft angle 20 of the club head (referred to as "square loft") is defined as the angle between the centerface normal vector and the ground plane when the head is in the square face address position. As shown in FIG. 3D, a hosel loft angle 72 is defined as the angle between the hosel longitudinal axis 60 projected onto the target line plane and a plane 74 that is tangent to the center of the centerface. The shaft loft angle is the angle between plane 74 and the longitudinal axis of the shaft 50 projected onto the target line plane. The "grounded loft" 80 of the club head is the vertical angle of the centerface normal vector when the club is in the grounded address position (i.e., when the sole 350 is resting on the ground), or stated differently, the angle between the plane 74 of the centerface and a vertical plane when the club is in the grounded address position.

Figure 3C:
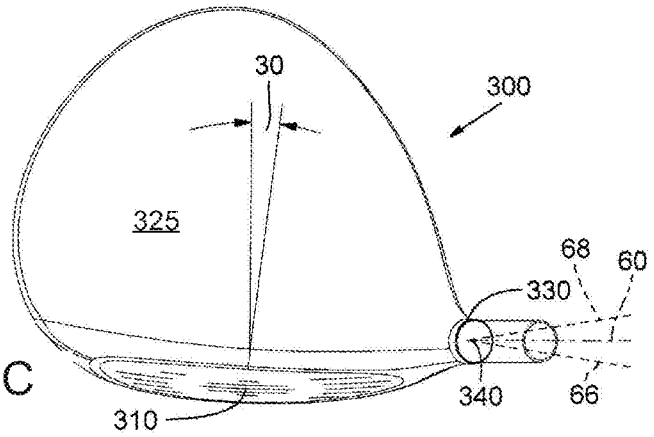
FIG. 3C is a top plan view of the golf club head of FIG. 3A.
Figure 3D:
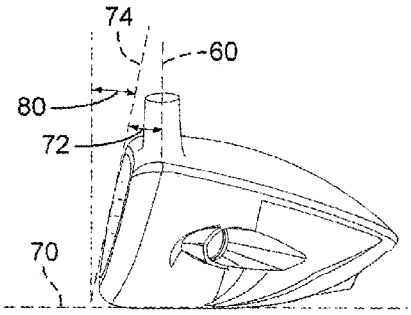
FIG. 3D is a side elevational view of the golf club head of FIG. 3A.

As shown in FIG. 3C, a face angle 30 is defined by the horizontal component of the centerface normal vector and a vertical plane ("target line plane") that is normal to the vertical plane which contains the shaft longitudinal axis when the shaft 50 is in the correct lie (i.e., typically 60 degrees +/−5 degrees) and the sole 350 is resting on the playing surface 70 (the club is in the grounded address position).

The lie angle 10 and/or the shaft loft can be modified by adjusting the position of the shaft 50 relative to the club head. Adjusting the position of the shaft can be accomplished by bending the shaft and the hosel relative to the club head. As shown in FIG. 3A, the lie angle 10 can be increased by bending the shaft and the hosel inward toward the club head 300, as depicted by shaft longitudinal axis 64. The lie angle 10 can be decreased by bending the shaft and the hosel outward from the club head 300, as depicted by shaft longitudinal axis 62. As shown in FIG. 3C, bending the shaft and the hosel forward toward the striking face 310, as depicted by shaft longitudinal axis 66, increases the shaft loft. Bending the shaft and the hosel rearward toward the rear of the club head, as depicted by shaft longitudinal axis 68, decreases the shaft loft. It should be noted that in a conventional club the shaft loft typically is the same as the hosel loft because both the shaft and the hosel are bent relative to the club head. In certain embodiments disclosed herein, the position of the shaft can be adjusted relative to the hosel to adjust shaft loft. In such cases, the shaft loft of the club is adjusted while the hosel loft is unchanged. Such clubs are described in US Patent Application Publication 2010/0197424, which is incorporated herein by reference.

Adjusting the shaft loft is effective to adjust the square loft of the club by the same amount. Similarly, when shaft loft is adjusted and the club head is placed in the address position, the face angle of the club head increases or decreases in proportion to the change in shaft loft. In some embodiments, the face angle and the loft are decoupled from one another by an adjustable sole plate. Hence, shaft loft is adjusted to effect changes in square loft and face angle. In addition, the shaft and the hosel can be bent to adjust the lie angle and the shaft loft (and therefore the square loft and the face angle) by bending the shaft and the hosel in a first direction inward or outward relative to the club head to adjust the lie angle and in a second direction forward or rearward relative to the club head to adjust the shaft loft. Adjustable soles are described in further detail in U.S. patent application Ser. No. 12/646,769, filed Dec. 23, 2009, which is incorporated herein by reference.

While the mechanical adjustments described about with reference to a wood-type golf club permit precise adjustment, the effectiveness of these adjustments can be limited by a golfer's ability to appropriately address and strike a golf ball. To aid in club placement, a club crown area 325 can be provided with a surface treatment so as to contrast with the club face 310. For example, the crown area 325 can be made so as to have a white, diffusing appearance and the club face 310 configured to appear black or otherwise dark. In this way the crown 325 contrasts with the playing surface 70 and the club face 310.

Representative examples of a driver-type club provided with contrast enhancement are shown in FIGS. 4A-4E and FIG. 5. Referring to FIGS. 4A-4E, a club head 402 includes a striking face 404, a sole 406, and a crown 408. The crown 408 is shown as stippled to denote a white appearing surface that provides substantial diffusion to incident light. The striking face 404 is provided with a dark diffusing surface to aid visibility. In an example shown in FIG. 5, a club head 502 includes a bright crown 508 and a striking surface 504 that includes portions 510, 512, either of which can be configured to contrast with the bright crown 508. For example, the portion 512 or the portion 510 can be provided with a white diffusing surface treatment or a dark diffusing surface treatment. One additional advantage that can be realized with a bright or white crown is that such surface treatments can make a club head appear larger, and improve player confidence.

Figure 1B:
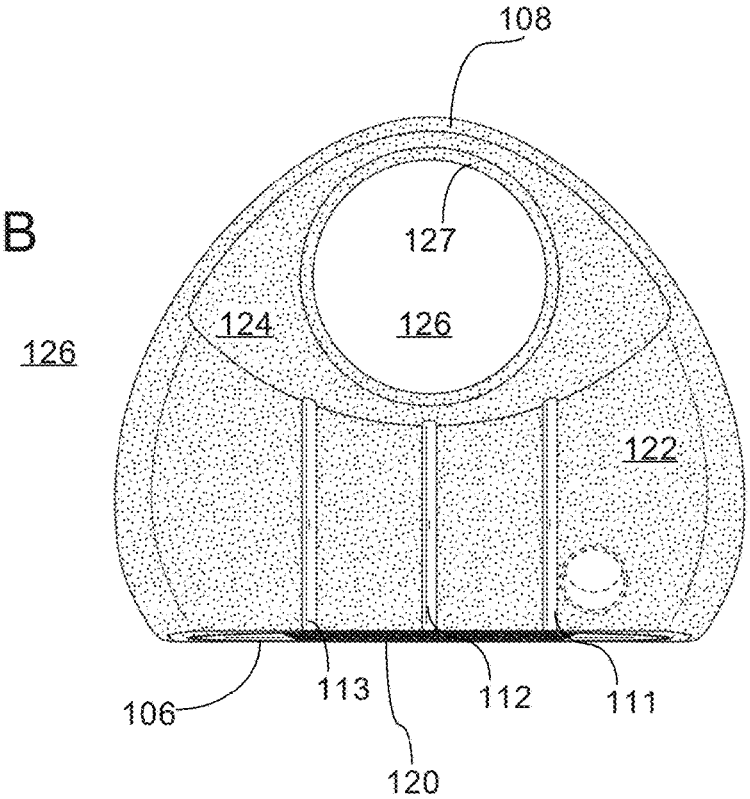
FIG. 1B is a top plan view of the putter head of FIG. 1A.
Figure 1C:
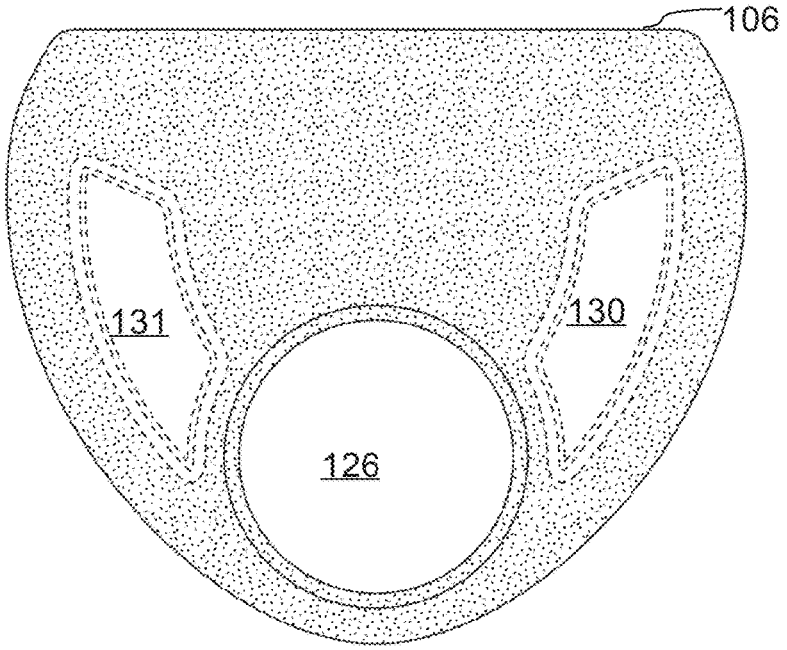
FIG. 1C is a bottom plan view of the putter head of FIG. 1A.
Figure 1D:
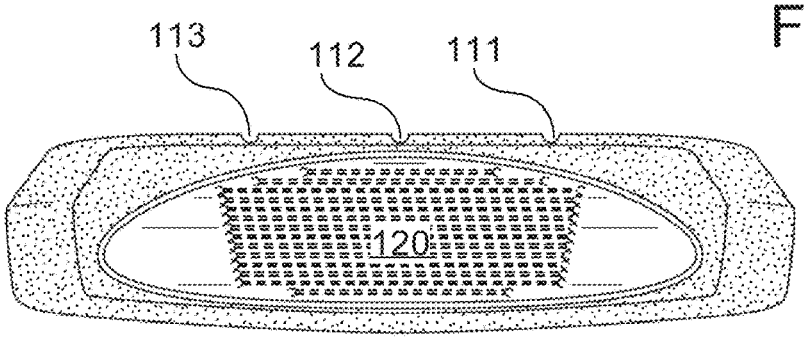
FIG. 1D is a front elevational view of the putter head of FIG. 1A.
Figure 1E:
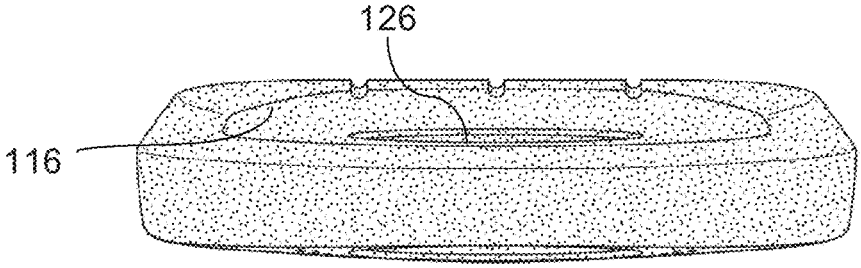
FIG. 1E is a back elevational view of the putter head of FIG. 1A.

While providing bright diffusing areas and contrasting dark areas facilitates golfer perception of a golf club, clubs such as drivers, fairway woods, and utility clubs ("wood-style clubs") do not typically include the substantial number of alignment aids that are available on putter heads such as shown in FIGS. 1A-1B. Alignment of wood-style clubs is especially important because if the striking surface is not properly aligned at impact, then the landing position of the ball will be farther off-line than shots with irons or a putter with equivalent impact misalignments. For example, if a driver is misaligned so as to be 2 degrees open at impact, the struck ball will end up about 24 yards off-line relative to the intended path, assuming an initial ball speed of 145 mph. Similarly, if a 6-iron is 2 degrees open relative at impact, the struck ball will end up about 13 yards off-line, and a wedge at 2 degrees open would be 2 yards off-line. In order to return the club to square at impact, the club face is preferably precisely aligned at address, prior to impact. For most golfers, a repeatable swing is difficult to achieve, and without a repeatable address alignment, even a repeatable swing will not produce repeatable results.

With regards to putters, studies have shown that on a 12-foot putt, only 35% of shots are aimed inside the cup at address, meaning 65% are aimed outside the cup. The tolerance for being inside the cup at 12 feet is ±0.85 degrees.

The two primary cues for aligning a metal wood type club at address are typically the crown/face masking line and the scorelines. Referring again to FIG. 4B, for the representative driver club head 402, a crown/face ball flight axis 455 extends forward and perpendicular to a crown/face masking line 450 and an scoreline ball flight axis 460 extends forward and perpendicular to scorelines 451 on the striking face. As shown in FIG. 4B, the axes 455, 460 do not point in the same direction. Typically, a scoreline-based axis such as the axis 460 appears to point a few degrees to the left of a crown/face based axis such as the axis 455. Crown/face masking lines associated with bright or white crowns such as those of FIGS. 4A-5 are more readily apparent to the golfer. Because the crown/face masking lines are more visible, golfers tend to rely more on the associated axis to align the club head, and tend to disregard scoreline-based alignment axes. In some examples, a durable bright white diffusing surface treatment is applied to a crown and a durable black (IP) surface treatment is applied to a striking face. It is further desirable to suitably configure scorelines to provide adequate contrast but not so much as to detract from the use of the crown/face line for club head alignment. Thus, scorelines are preferably not bright white to provide maximum contrast with respect to a black striking face, but instead are an intermediate gray so as not to confuse alignment.

While a white or reflective crown promotes more accurate alignment of a club head with respect to an intended line of flight, the visually larger club head tends to result in shots struck somewhat above the striking face center. To assist in more centered ball striking, scorelines (such as the scorelines 451 of FIG. 4B) can be moved down the striking face with respect to the club face center, typically by no more than about 0.5 mm, 1.0 mm, 2 mm, or 3 mm.

Figure 6:
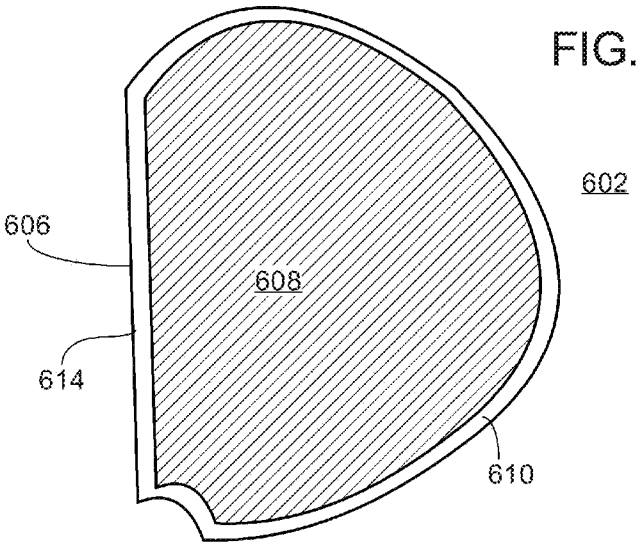
FIG. 6 is a top plan view of a crown of a golf club head according to an additional embodiment.

While providing a substantial upward facing portion of a golf club crown with a white or other bright surface treatment can provide substantial increases in visibility, such treatments can also be provided on selected portions of a crown. Referring to FIG. 6, a club head 602 includes a face 606 and a crown having a central portion 608 and a perimeter portion 610. The perimeter portion 610 is preferably provided with a white diffusing surface treatment, while the inner portion 608 can have a different surface treatment. In other examples, only a portion of the crown 602 at face/crown interface 614 is provided with a white or bright contrasting surface treatment, as this portion serves as a significant alignment aid.

Figure 7:
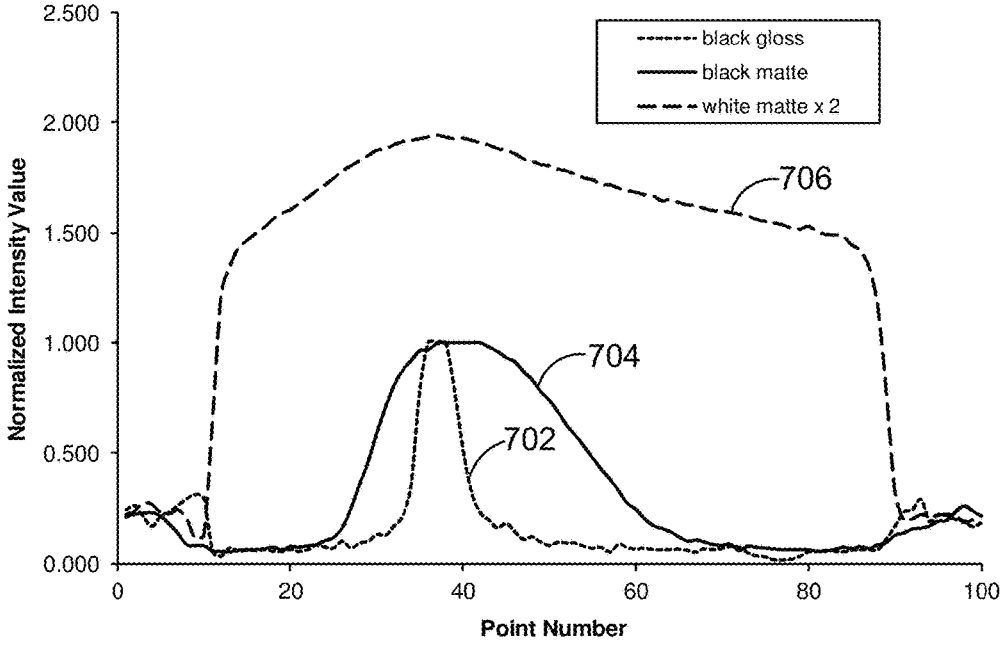
FIG. 7 is a graph illustrating relative reflected intensity across a crown of a driver type golf club head for club heads with black glossy, black matte, and white matte finishes.

FIG. 7 is a graph of relative reflected light intensity from a golf club head crown as a function of position for three different surface treatments. Data were obtained by evaluating digital photographs obtained under similar lighting conditions. Curves 702 and 704 correspond to glossy and matte black surfaces, respectively, and curve 706 corresponds to a white matte surface. The relatively intensities associated with the curve 706 are based on a digital photograph at an effective shutter speed that was twice that used to obtain data for the curves 702, 704. The curve 706 shows that the reflected light intensity for a white surface is substantially greater than that of the glossy or matte black dark surfaces associated with the curves 702, 704, and the intensity is varies by less than about 20% over the crown, while both dark surfaces have much narrower distributions that vary at least 90% over the same area.

Figure 8:
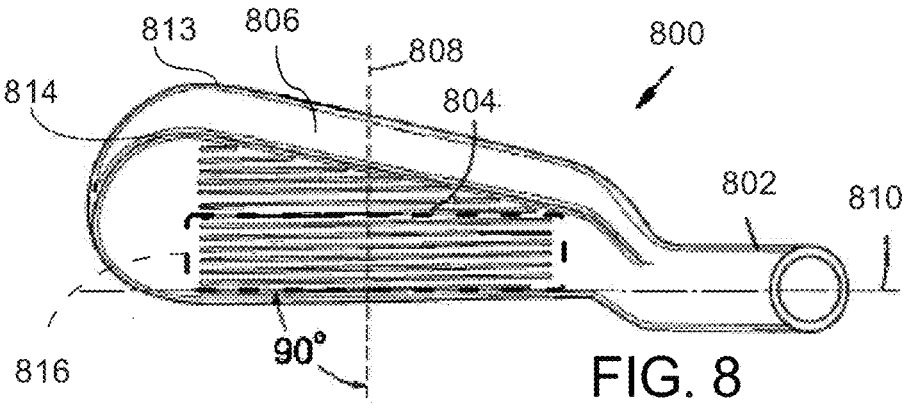
FIG. 8 is a top plan view of one embodiment of an iron type golf club head at normal address position.

Iron-type clubs can also be provided with visibility enhancements based on diffusely reflecting surfaces. FIG. 8 is a top plan view of one embodiment of an iron type golf club head 800 at normal address position. The club head 800 is a unitary club head that includes a hosel 802 and a striking face 804. At normal address position, the club head 800 rests on a ground plane that is parallel to the ground. In this "normal address position" a vector normal to the striking face 804 lies in a first vertical plane 808 (i.e., a vertical plane that is perpendicular to the ground plane), a centerline axis 810 of the club shaft lies in a second vertical plane, and the first vertical plane 108 and the second vertical plane perpendicularly intersect.

To aid alignment of the club head 800 and to provide the club head 800 with a larger appearance, the striking face 804 can be provided with white, off-white, eggshell-white or other surface treatments. Selected portions of the striking surface or the entire striking surface can be provided with such a treatment. The top line 806 can have a similar surface treatment. However, referring to FIG. 8, it is apparent that edges 813, 814 of the top line 806 are generally not perpendicular to an expected line of flight that is perpendicular to the striking surface. Thus, white surface treatment of the top line 806 may be combined with enhanced visibility scorelines (or an enhanced visibility portion of the striking face) to provide alignment aids for the golfer. As shown in FIG. 8, a portion 816 of the striking face 804 is provided with a white contrast enhancing surface treatment.

Representative Embodiments

In the following description of embodiments, some club head surfaces are described with reference to surface gloss. Smooth, polished surfaces generally exhibit a high gloss, and directly reflect light received, and depending on surface curvatures, can form one or more magnified, demagnified, real, or virtual images. Rough surfaces scatter light diffusely, and generally do not form clear images as do smooth surfaces. Surface gloss can be characterized by illuminating a surface at a specific angle, and measuring light intensity received in a range of reflection angles. Gloss measurements can be made with reference to the amount of light reflected from a black glass standard having a specified refractive index. In this way, gloss measurements can be established without direct reference to input light intensity. Standard gloss measurement geometries are specified for three gloss ranges: semigloss for surface glosses between 10 and 70 gloss units measured with a standard 60 degree geometry, high gloss for surface glosses greater than 70 gloss units measured with a standard 20 degree geometry, and low gloss for surface glosses that are less than 10 gloss units measured with a standard 80 degree geometry.

In some disclosed examples, surface gloss is referred to as semigloss or low gloss. As used herein, semigloss refers to a range of 10 to 70 gloss units measured with respect to a standard 60 degree geometry. However, some examples include semigloss surfaces having surface gloss in ranges having lower limits of 10, 20, 30, 40, 50, or 60 gloss units and upper limits of 20, 30, 40, 50, 60, or 70 gloss units. Similarly, low gloss surfaces include surfaces associated with standard gloss values of less than 10, 8, 5, 4, or 2 gloss units. Semigloss surfaces are typically preferred due to a chalky appearance that can be associated with low gloss surfaces. Gloss measurements can be conveniently made with portable glossmeters such as the MICRO-TRI-GLOSS meters from BYK Additives and Instruments.

Examples are also described, for convenience, with respect to CIELab color space using L*a*b* color values or L*C*h color values, but other color descriptions can be used. As used herein, L* is referred to as lightness, a* and b* are referred to as chromaticity coordinates, C* is referred to as chroma, and h is referred to as hue. In the CIELab color space, +a* is a red direction, −a* is a green direction, +b* is a yellow direction, and −b* is the blue direction. L* has a value of 100 for a perfect white diffuser. Chroma and hue are polar coordinates associated with a* and b*, wherein chroma (C*) is a distance from the axis along which a*=b*=0 and hue is an angle measured counterclockwise from the +a* axis. The following description is generally based on values associated with standard illuminant D65 at 10 degrees. This illuminant is similar to outside daylight lighting, but other illuminants can be used as well, if desired, and tabulated data provided herein generally includes values for illuminant A at 10 degrees and illuminant F2 at 10 degree. These illuminants are noted in tabulated data simply as D, A, and F for convenience. The terms brightness and intensity are also used in the following description to refer to CIELab coordinate L*.

Club Head Intensity Profiling

Some disclosed examples are described with respect to "hot spots" or other optical intensity profiles that are apparent on a wood-type club head crown, or a top surface of any club type with the club in a standard address position. Hot spots are visually distracting, and tend to promote club head misalignment or reduce golfer confidence in club head alignment. Suitable methods are described for reducing or eliminating such hot spots, typically so as to produce substantial areas of uniform visual intensity as viewed by a player with a club in a normal address position. As used herein, a "light diffusing region" of a club head refers to a portion of a club head surface over which reflected/diffused light intensity directed to a golfer with the golf club in a normal address position is at least 20%, 30%, 40%, 50%, 60%, 70%, 80%, or 90% of a maximum intensity of such reflected or diffused light. To promote accurate club head alignment without the visual impairment and distraction associated with hot spots, such diffusing regions can occupy substantial portions of an upward facing club head surface. A representative method for determining such light diffusing regions used in characterizing some embodiments is described below.

Figure 9A:
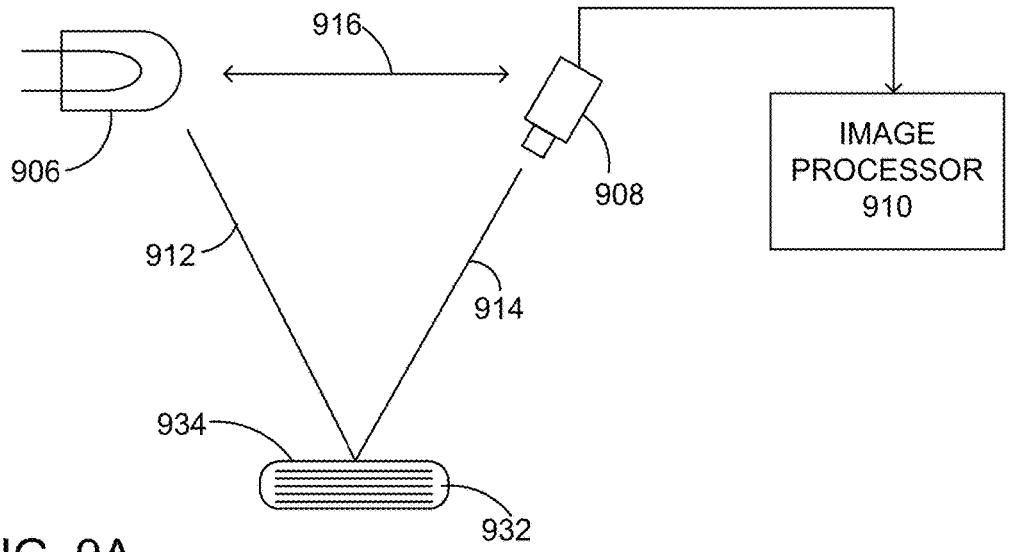
FIG. 9A illustrates a representative system for measuring club head surface reflectance for putter type clubs.

Referring to FIG. 9A, a club or club head 902 is situated on a flat surface (typically a work surface such as a table top or floor) with a club crown 904 or other club top surface facing a light source 906 such as a FEIT Electric 15 W compact fluorescent lamp (CFL) having an A-type bulb and emitting light with a color temperature of 2700 K. The club head 902 is adjusted so that a hot spot or center of specular reflection or diffuse reflection from the crown 904 or club top surface appears near the center of the surface. The crown 904 can be imaged with a digital SLR camera 908 such as a CANON EOS REBEL XTi with an f/5.6 zoom lens set to have a focal length of between 56 and 64 mm. Image resolution of 1936 (w)×1288 (h) pixels is convenient. Shutter speed can be varied based on the intensity of light received from the club head to avoid detector saturation as described below. Images can be captured in an sRGB color format. The camera is secured to a tripod, and the camera, club head, and light source is enclosed in a black light tent to reduce the effects of light from sources other than the light source 906.

For a putter type club, the arrangement of FIG. 9A is used and the light source 906 is situated so as to provide an illumination distance of about 27 inches from the club along an axis 912, and the club head surface is situated about 23 inches from the camera sensor along an axis 914. The light source 906 and the camera sensor 908 are separated by a distance 916 of about 24 inches.

Figure 9B:
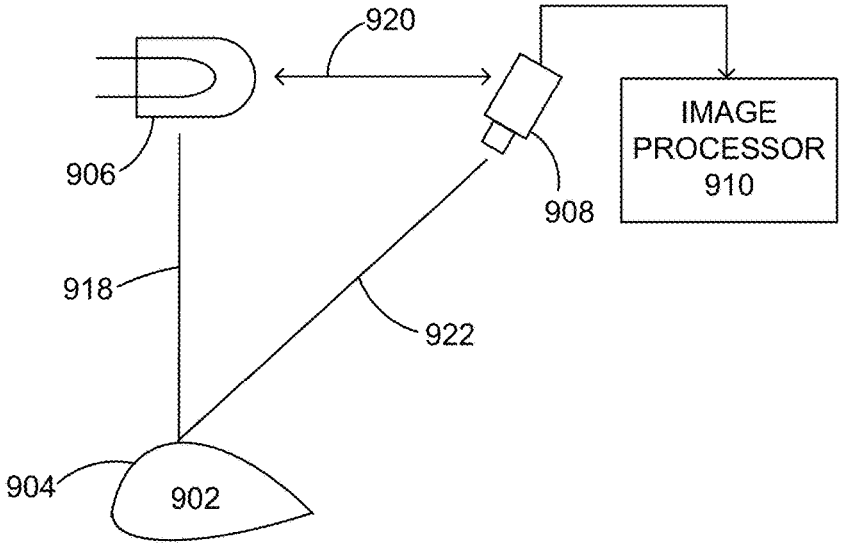
FIG. 9B illustrates a representative system for measuring club head surface reflectance for metalwood type clubs.

FIG. 9B illustrates a second test setup for metalwood club heads where the light source 906 is positioned virtually directly over the club head 902. The light source 906 is situated so as to provide an illumination distance of about 22 inches from the club along an axis 918, and the club head surface is situated about 27 inches from the camera sensor along an axis 922. The light source 906 and the camera sensor 908 are separated by a distance 9920 of about 18 inches.

Image data from the camera 908 is provided to a computer system 918 or other processing system for analysis using MATLAB mathematical analysis software, but other processing systems and software can be used.

Exposures are set by adjusting image intensity so that maximum pixel intensity value is non-saturated and within a range of greater than 90% and less than 100% of maximum intensity value for the camera sensor. The camera 908 can be set to provide RGB values in a range of 0 to 255. A saturated pixel would have pixel values (255, 255, 255) while a non-saturated pixel would have values of, for example, (254, 254, 254). Intensity is computed as a weighted sum 0.2989*R+0.5870*G+0.1140*B based on R, G, B values provided by the camera 908 using MATLAB's rgb2gray function which converts image data to to HSV color space, and produces "V" values or luminance values which are referred to herein as intensities. Pixel intensities can be deemed acceptable when peak pixel intensity is greater than 229.5 and less than 255. To obtain suitable image intensities, images can be obtained using auto focus and averaging metering mode, and the shutter speed set for Exposure Value (EV) 0. An image is then obtained, and camera histogram mode used to identify saturation. If any saturated pixels are detected, the shutter speed can be doubled (i.e. the exposure time halved), and a new image acquired. This process can be repeated as needed. Even after saturation is eliminated, additional images could be acquired at a faster shutter speed to confirm that saturation has been eliminated.

Intensity images can be evaluated by selecting a pixel having a maximum intensity and establishing an image radius that is the longest radius that can be extended from the maximum intensity pixel to the image border. A pixel radius can be defined as a horizontal distance from the crown location associated with the maximum intensity pixel to an edge of the crown surface along an image radius. For convenience, this distance can also be referred to as an effective plan radius (EPR) as this distance is associated with an apparent crown extent as shown in a plan view of a club head (i.e., looking downward with the club in standard address position). In certain embodiments, a crown effective length can be defined as a length of a longest of a plurality of pixel radii from the brightest intensity location to the edge of a crown surface. In other embodiments, an effective crown region or zone can be defined as being a region of the crown surface that contains the longest pixel radius and the surface area between the longest pixel radius and the two adjacent pixel radii at angles of ±30 degrees with respect to the longest pixel radius so as to form a "slice" or triangular area wherein a secondary location on the crown a distance of at least 50% at any given pixel radius within the effective crown region is associated with an reflected intensity that is at least 20%, 30%, 40% or 50% of the highest reflected intensity. In other words, a zone of crown intensity is defined from the crown effective length in a direction of 30 degrees and negative 30 degrees from the crown effective length orientation, the zone of crown intensity being greater that at least 20%, 30%, 40% or 50% of the highest reflected intensity Intensity values can be scaled by dividing by 255 to be positive and less than 1. Point values along lines at angles of 0, 30, 60, 90, 120, 150, 180, 210, 240, 270, 300, and 330 degrees extending from the maximum value pixel a distance of the image radius are obtained by interpolation of pixel values. These point values can be plotted to characterize a light diffusing region or to locate undesirable hot spots. Unless stated otherwise, image intensities were obtained in this manner for the examples described below. It will be appreciated that an image radius established in this manner generally extends beyond a club head surface. A crown effective length can be defined as a longest distance from the crown location associated with the maximum intensity pixel to a crown perimeter along which a light intensity is measured. In other embodiments, the crown effective length can be defined as a specific pixel radius selected from a plurality of pixel radii according to orientation or length characteristics of the pixel radii. In addition, the crown effective length can be selected to define a ratio of a second point location (number of points) along the crown effective length from the maximum intensity point to a total number of points along the crown effective length to the crown perimeter.

Selected Wood Type Club Head Intensity Profiles

For purposes of illustration, intensity profile results for selected club heads are described. For convenience, examples include both contrast-enhanced clubs and conventional clubs to illustrate differences. In addition, CIELab data and gloss values are provided for selected embodiments associated with contrast-enhancement as well as some conventional club heads.

Figure 10:
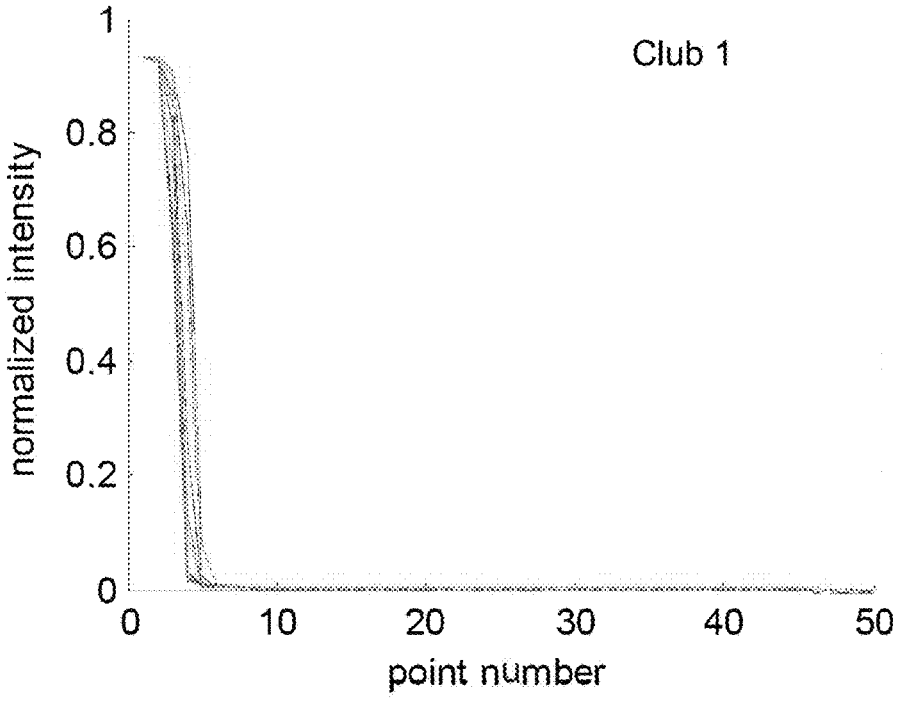
FIG. 10 is graph illustrating measured crown surface brightness along a plurality of pixel radii spaced at 30 degrees for a conventional glossy black driver crown.
Figure 11:
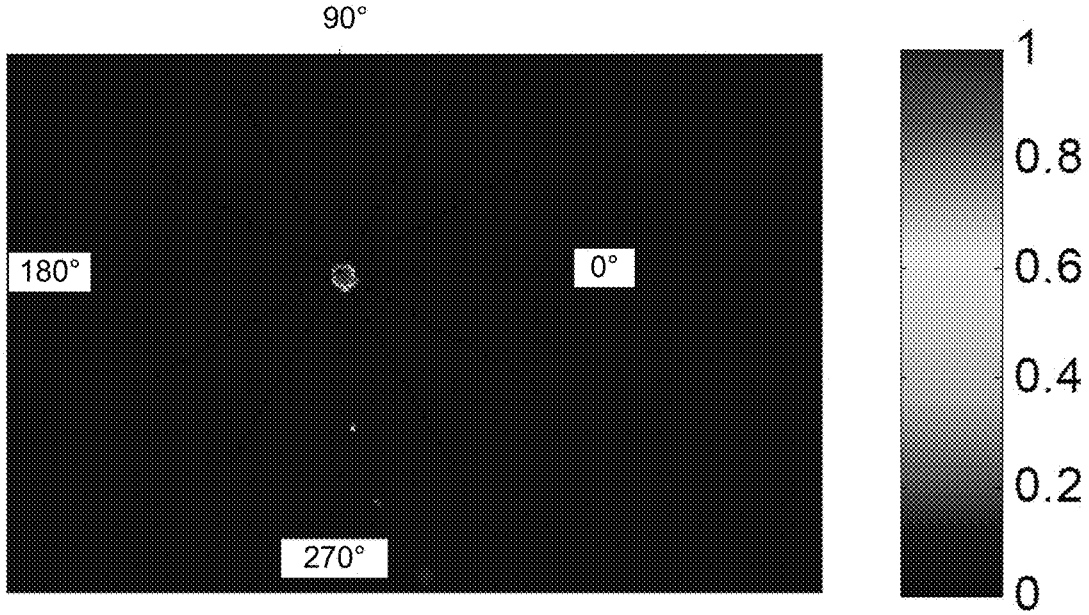
FIG. 11 illustrates selected equal intensity contours for the club head associated with FIG. 10 and further illustrating pixel radii along which surface brightness is graphed.

A representative intensity contour map associated with a conventional glossy black club head crown (club 1) is provided in FIG. 10. The graph of FIG. 10 plots relative image intensity about axes extending along a plurality of angles (0 to 330 degrees in 30 degree increments) on the club head crown as shown in FIG. 11. In addition, FIG. 11 also includes representative contour lines associated with constant relative surface brightness. The contour lines are provided for convenient illustration only, and actual contour line locations are based on data such as that used in FIG. 10. FIG. 10 show that relative surface intensity declines from its maximum value to near zero in fewer than about 5 points along the pixel radius. A crown portion in which relative intensity is greater than about 0.7 has a radius of less than about 4 points, indicative of a hot spot associated with this conventional club's glossy crown. The remainder of the crown appears dark, having a relative intensity of less than 0.004. Thus, this conventional crown has a pronounced hot spot on an otherwise dark surface.

Figure 12:
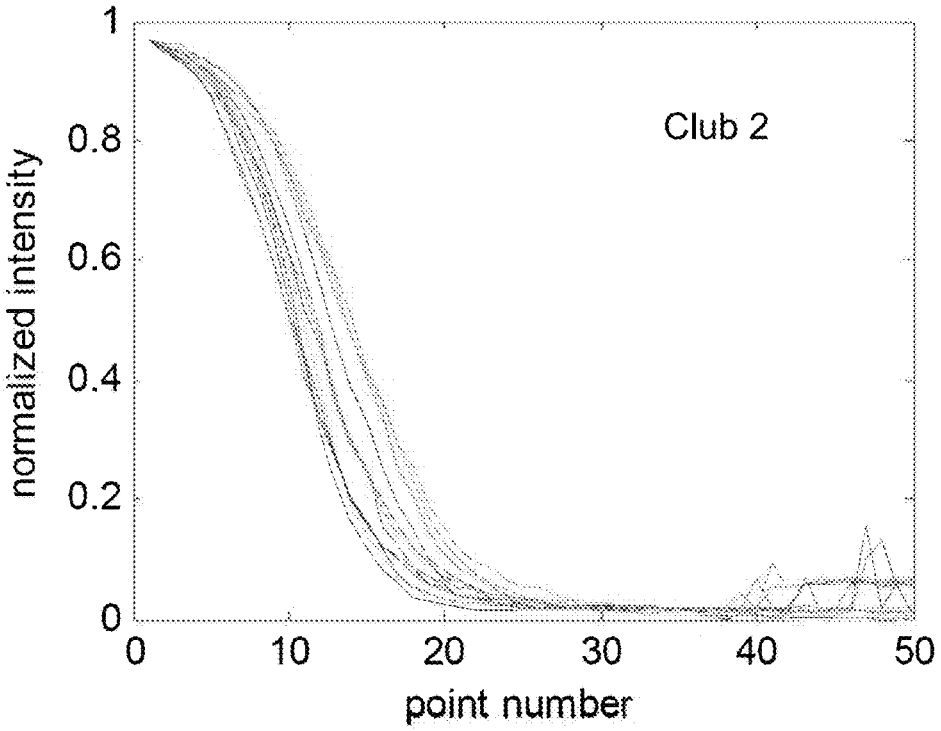
FIG. 12 is a graph illustrating measured crown surface brightness along a plurality of pixel radii spaced at 30 degrees for a matte black driver crown.
Figure 13:
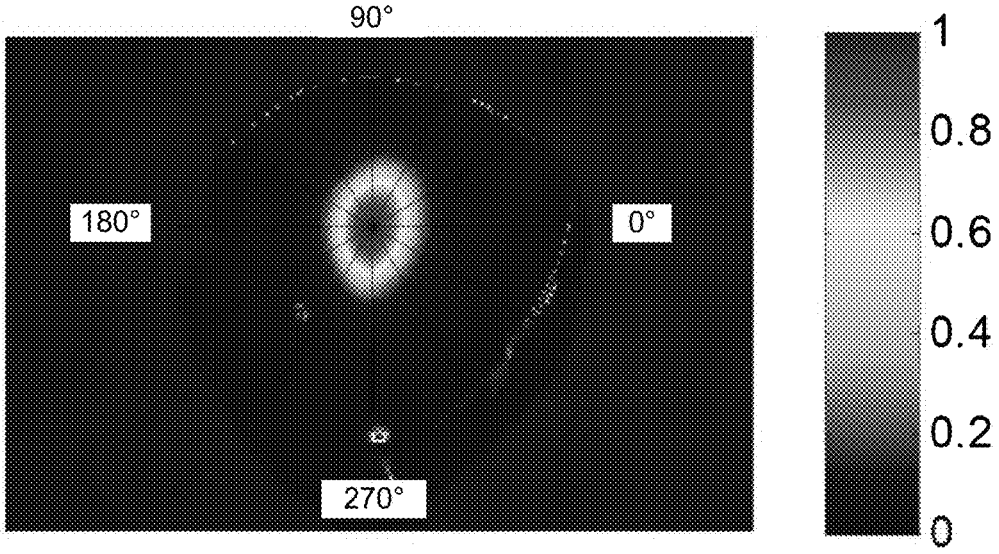
FIG. 13 illustrates selected equal intensity contours for the club head associated with FIG. 12.

FIGS. 12-13 illustrate hot spot reduction and an enlarged light diffusing area associated with application of a matte coating to a crown (club 2) similar to that associated with FIGS. 10-11. Considerable spreading of the crown hot spot is apparent, with relative intensity dropping to near zero over about a 20 point radius, and a crown effective length associated with an intensity of greater than about 0.7 is based on a distance corresponding to about 10 points in FIGS. 12-13. Nevertheless, a substantial portion of this matte crown has low intensity (less than 0.05 at points greater than 25) with the exception of a slight increase in intensity near the crown perimeter.

Figure 14:
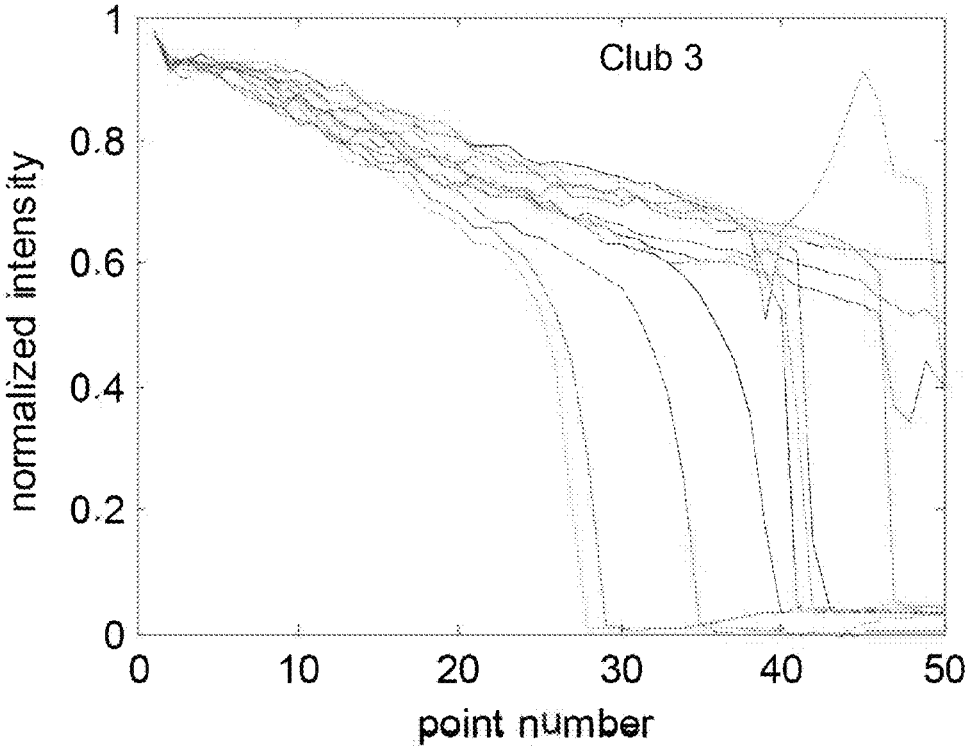
FIG. 14 is a graph illustrating measured crown surface brightness along a plurality of pixel radii spaced at 30 degrees for a contrast enhanced white driver crown.
Figure 15:
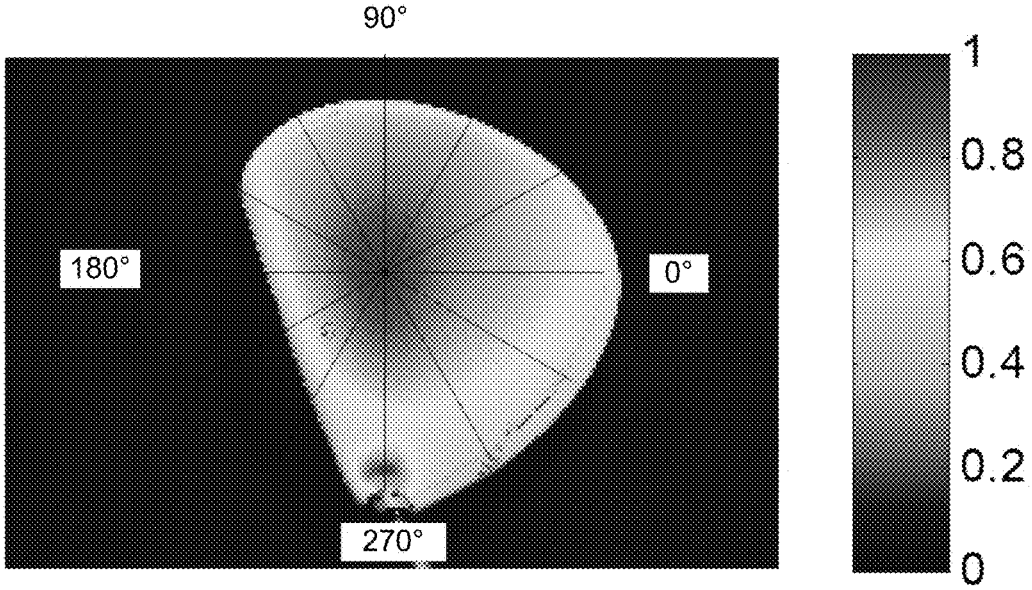
FIG. 15 illustrates selected equal intensity contours for the club head associated with FIG. 14.

FIG. 14 is a graph of crown intensity and FIG. 15 is an intensity contour map for a metal wood driver (club 3) crown surface that is provided by a contrast-enhancing coated that includes a primer layer, a white base coat of thickness 0.00125 in. or about 0.001-0.002 in., a pearl layer of thickness 0.0008 in. or about 0.0007-0.0009 in., and a topmost matte clear layer of thickness 0.0008 in. or about 0.0007-0.0009 inches. Representative club heads have volumes greater than 400 $cm^3$ and crown thicknesses of between 0.7 and 1.0 mm, or 0.8 and 0.9 mm. In some examples, metalwoods have volumes of at least 400 $cm^3$ and crowns of thickness less than or equal to about 0.8 mm over more than 40%, 50%, or 60% of the crown surface area. Alternatively, crown thickness can be less than 1.0 mm, 0.9 mm, or 0.85 mm over 40%, 50%, or 60% of the crown surface area. In one embodiment, the base coat thickness is the thickest layer of the individual coating layers to achieve a desired diffusivity. In another embodiment, the primer coat has a thickness of about 40-60 μm, the paint layer has a thickness of about 75-95 μm, and the clear coat layer has a thickness of about 105-125 μm.

Considerable improvement is apparent, with relative intensity dropping to about 0.7 of a maximum value at about 20-40 points, and not approaching zero except when the club head perimeter is reached. With reference to FIG. 15, it will be appreciated that along radii at some angles, the relative intensity reduction is primarily associated with proximity to the crown perimeter, indicating that such a crown would have a substantially uniform light diffusing appearance over a large surface portion. Indeed, crown intensity does not drop to zero as with a conventional, glossy crown. The diffusing surface of this crown tends to reduce hot spots and the white surface treatment tends to increase surface intensity over that of a black crown, producing the substantially uniform crown intensity.

Figure 16:
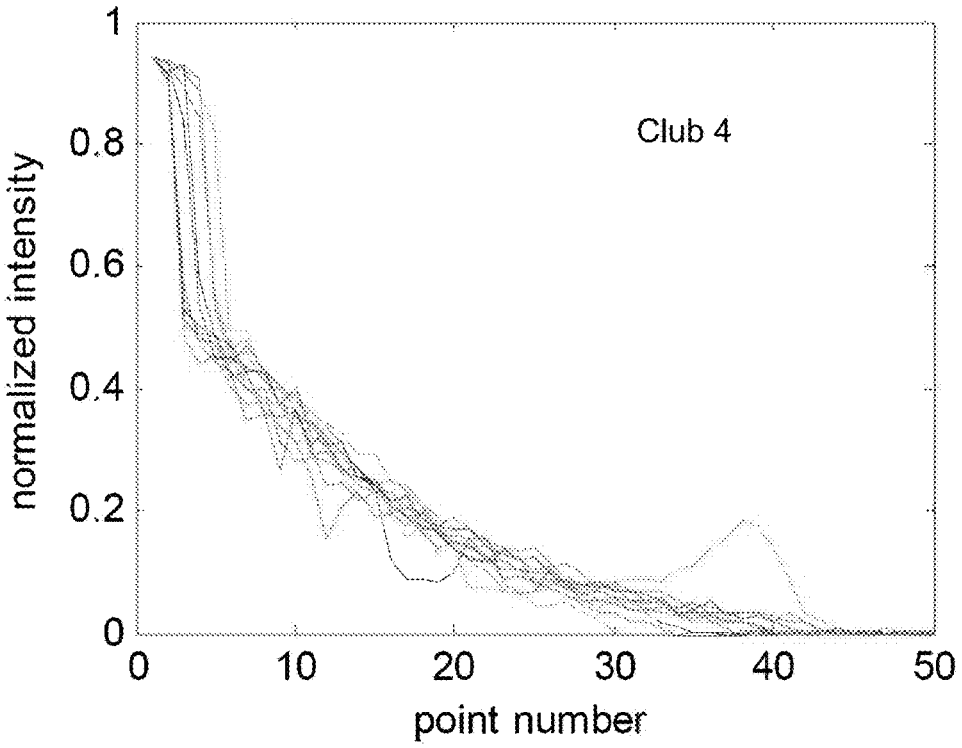
FIG. 16 is a graph illustrating measured crown surface brightness along a plurality of pixel radii spaced at 30 degrees for a conventional non-black driver crown.
Figure 17:
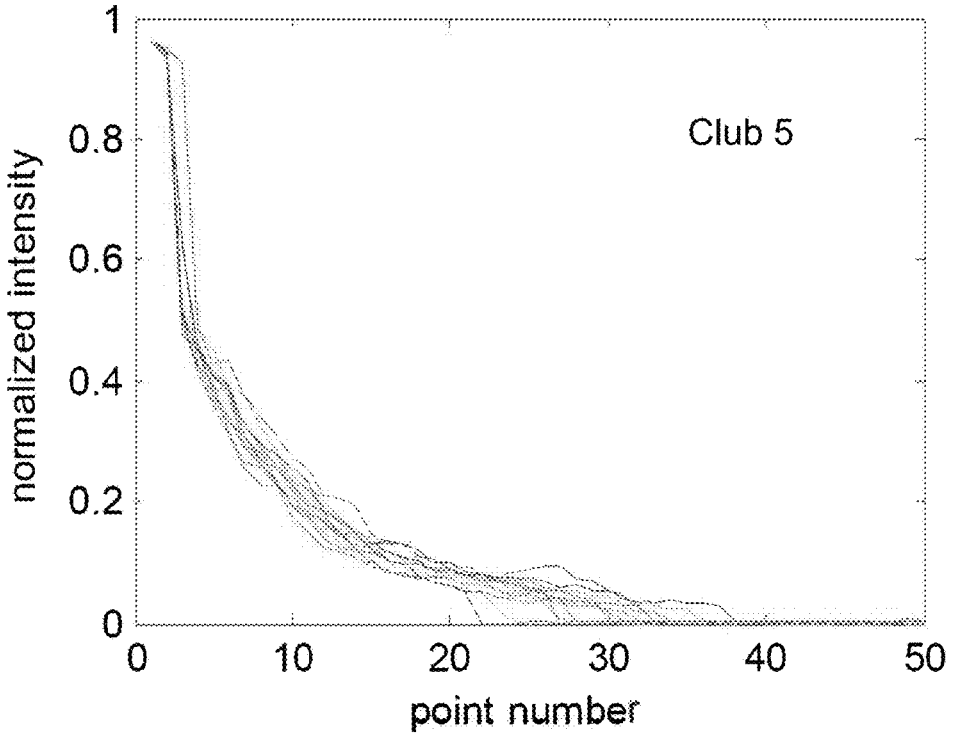
FIG. 17 is a graph illustrating measured crown surface brightness along a plurality of pixel radii spaced at 30 degrees for a non-black metal type fairway wood crown.

FIGS. 16-17 are graphs of crown intensity for two conventional metal wood type clubs (club 4 and club 5, respectively) that are provided with surfaces that are not black. As with the conventional glossy black crown of FIGS. 10-11, crown intensity decreases rapidly from a relative intensity maximum to about 0.7 at less than about 5-8 points. In addition, perimeter portions of the crown (points greater than about 15) have intensities of less than about 0.1. Thus, these conventional clubs also exhibit pronounced and visually distracting hot spots.

Figure 18:
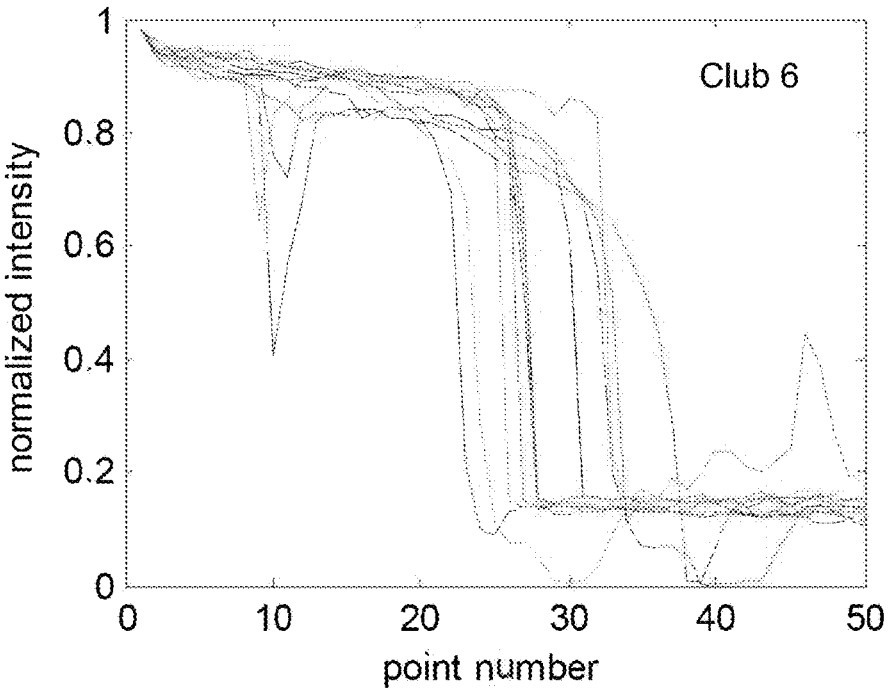
FIG. 18 is a graph illustrating measured crown surface brightness along a plurality of pixel radii spaced at 30 degrees for a polymer driver crown.
Figure 19:
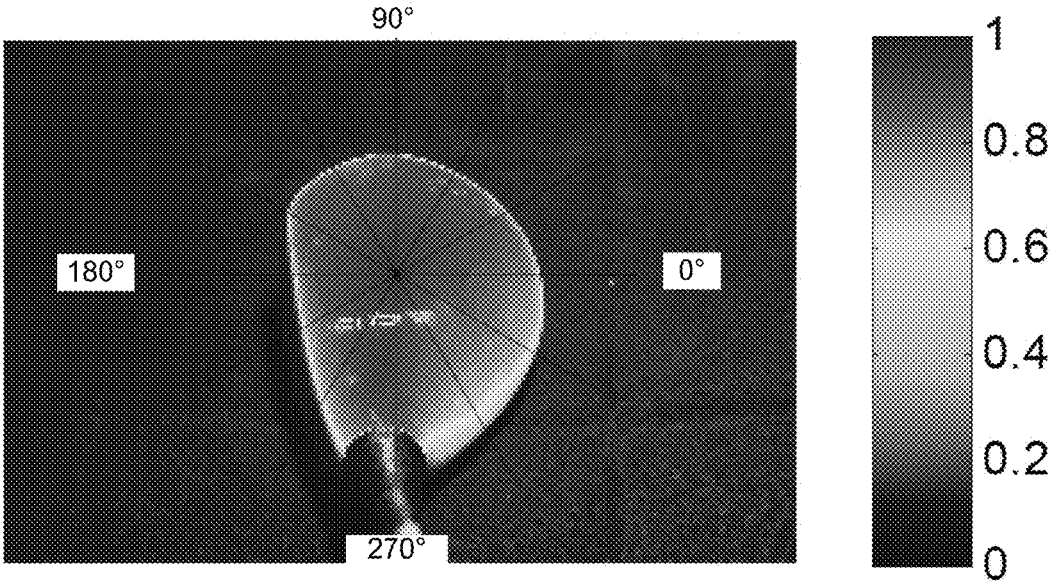
FIG. 19 illustrates selected equal intensity contours for the club head associated with FIG. 18.

FIGS. 18-19 provide intensity data and contour maps for a conventional solid composite construction fairway wood (club 6). By virtue of its composite construction and a cream-colored appearance, hot spots do not appear. As this club is a solid composite, its club face is also a composite face of similar appearance to the crown, in contrast to the metal woods described above that have metallic striking faces.

Figure 20:
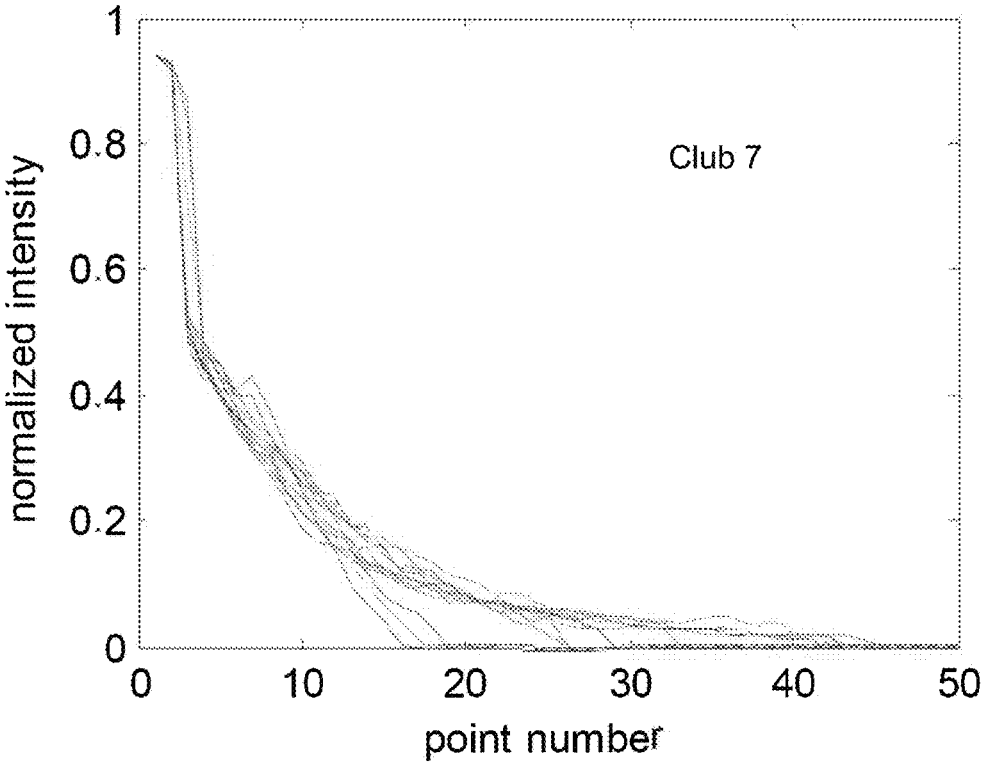
FIG. 20 is a graph illustrating measured top surface brightness along a plurality of pixel radii spaced at 30 degrees for another conventional driver.

FIG. 20 is a graph of intensity data for another conventional metal type driver (club 7) having a light (non-black) crown. As is readily apparent, this club too exhibits a significant hot spot.

Figure 21:
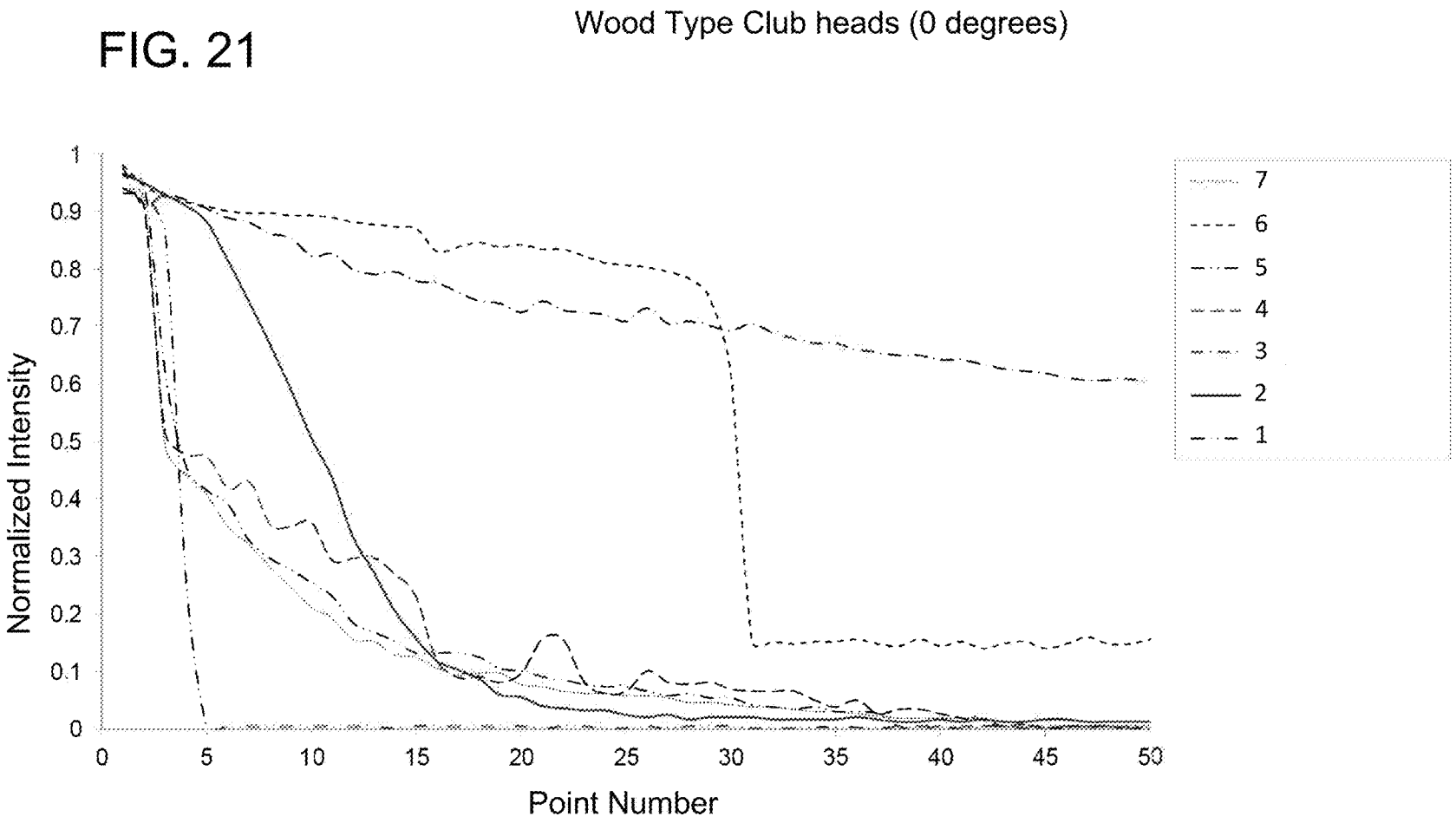
FIG. 21 is a graph summarizing measured top surface brightness along a 0 degree radius for a plurality of club heads.

FIG. 21 is a summary graph illustrating crown reflected light intensity for a variety of wood type club heads as described above. For each club head, data along a pixel radius at 0 degrees was selected.

Selected Wood Type Club Head Colorations

CIELab coordinates for the club head crowns associated with FIGS. 10-20 are provided in Tables 1A-1B below. Larger L* values appear brighter, and smaller absolute values of a* and b* are associated with more color neutral appearance. In addition, small values of chroma (C*) are accordingly also associated with a more color neutral appearance. As noted above, the composite club head associated with FIGS. 18-19 has relatively large b* and C* values, as well as a relatively low L* value. Thus, this club appears cream colored, and not white. The remaining conventional club crowns also have low L* values, and thus do not have a bright white appearance, and do not provide the contrast-enhancement available with the diffusing white club associated with FIGS. 14-15 which has an L* value of 93 and a C* value of less than 1.3, indicating a bright white, color neutral appearance. This club head can also be configured to have a semigloss surface with gloss values in ranges from 10-70, 20-60, 30-50, or 35-45 gloss units or any other sub-range within the semigloss range defined above. In addition, club head crowns can also be configured to have lower gloss values (in the low gloss range). While such club head crowns can provide enhanced contrast and do not tend to exhibit hot spots, such low glosses tend to appear chalky and may not appeal to some golfers for this reason.

TABLE 1A

CIELab values for crowns of selected wood-type golf clubs.

| | Club Identifier | | | | | |
|---|---|---|---|---|---|---|
| | 4 | | | 3 | | |
| Illuminant | D65 | A | F2 | D65 | A | F2 |
| L* | 75.74 | 76.03 | 75.98 | 93.17 | 93.04 | 93.11 |
| a* | 0.40 | 1.12 | 0.23 | −1.22 | −1.06 | −0.74 |

TABLE 1A-continued

CIELab values for crowns of selected wood-type golf clubs.

| | Club Identifier | | | | | |
|---|---|---|---|---|---|---|
| | 4 | | | 3 | | |
| Illuminant | D65 | A | F2 | D65 | A | F2 |
| b* | 3.59 | 3.87 | 4.14 | 0.20 | −0.28 | 0.03 |
| C* | 3.62 | 4.03 | 4.15 | 1.24 | 1.10 | 0.74 |
| h | 83.64 | 73.81 | 86.80 | 170.83 | 195.04 | 177.97 |

TABLE 1B

CIELab values for crowns of selected wood-type golf clubs.

| | Club Identifier | | | | | |
|---|---|---|---|---|---|---|
| | 6 | | | 7 | | |
| Illuminant | D65 | A | F2 | D65 | A | F2 |
| L* | 67.06 | 67.95 | 67.76 | 81.44 | 81.74 | 81.71 |
| a* | −2.09 | 1.99 | −1.60 | 1.02 | 1.38 | 0.66 |
| b* | 17.97 | 17.74 | 20.43 | 2.68 | 3.10 | 3.14 |
| C* | 18.09 | 17.85 | 20.50 | 2.87 | 3.39 | 3.21 |
| h | 96.63 | 83.60 | 94.49 | 69.19 | 66.02 | 78.14 |

Striking Face Characteristics

A contrast-enhanced crown provides the golfer with superior visibility of a club head at address, increases the apparent (visual) size of the club head, and eliminates or reduces distracting hot spots. With such a club head, the golfer can better visualize ball/club alignment at address. To further improve golfer perception, a club head with a contrast enhanced crown can be provided with a contrasting striking face so that a top portion of a crown/striking face boundary becomes more apparent. For a white, diffusing crown, a dark or black appearing striking face can be used. CIELab values for a representative black striking face as well as several conventional clubs referred to above are included in Table 2.

TABLE 2

CIELab values for various club striking faces.

| | Club Identifier | | | | | | | | |
|---|---|---|---|---|---|---|---|---|---|
| | 4 | | | 3 | | | 6 | | |
| Illuminant | D65 | A | F2 | D65 | A | F2 | D65 | A | F2 |
| L* | 39.66 | 39.91 | 39.82 | 25.39 | 25.32 | 25.35 | 66.12 | 67.01 | 66.80 |
| a* | 0.43 | 1.18 | 0.26 | −0.20 | −0.38 | −0.15 | −1.78 | 2.18 | −1.40 |
| b* | 2.93 | 3.16 | 3.36 | −0.65 | −0.73 | −0.72 | 17.47 | 17.34 | 19.87 |
| C* | 2.96 | 3.37 | 3.37 | 0.67 | 0.82 | 0.74 | 17.56 | 17.48 | 19.92 |
| h | 81.55 | 69.49 | 85.58 | 252.97 | 242.67 | 258.53 | 95.81 | 82.82 | 94.04 |

Referring to Tables 1-2, a contrast enhanced club crown coupled with a black or other contrasting striking face can have a crown-face brightness difference ΔL of about 68, but greater or lesser differences can be used, for example, differences of about 20, 40, 50, 60, or 70 can be provided. The higher the ΔL value between the crown and face, the easier it will be for the golfer to align the face angle at the address position. In one embodiment, a ΔL of greater than 40 is preferred. In another embodiment, a ΔL of greater than about 50 or 60 is even more preferred to provide a very high contrast from the crown to face.

Figure 22:
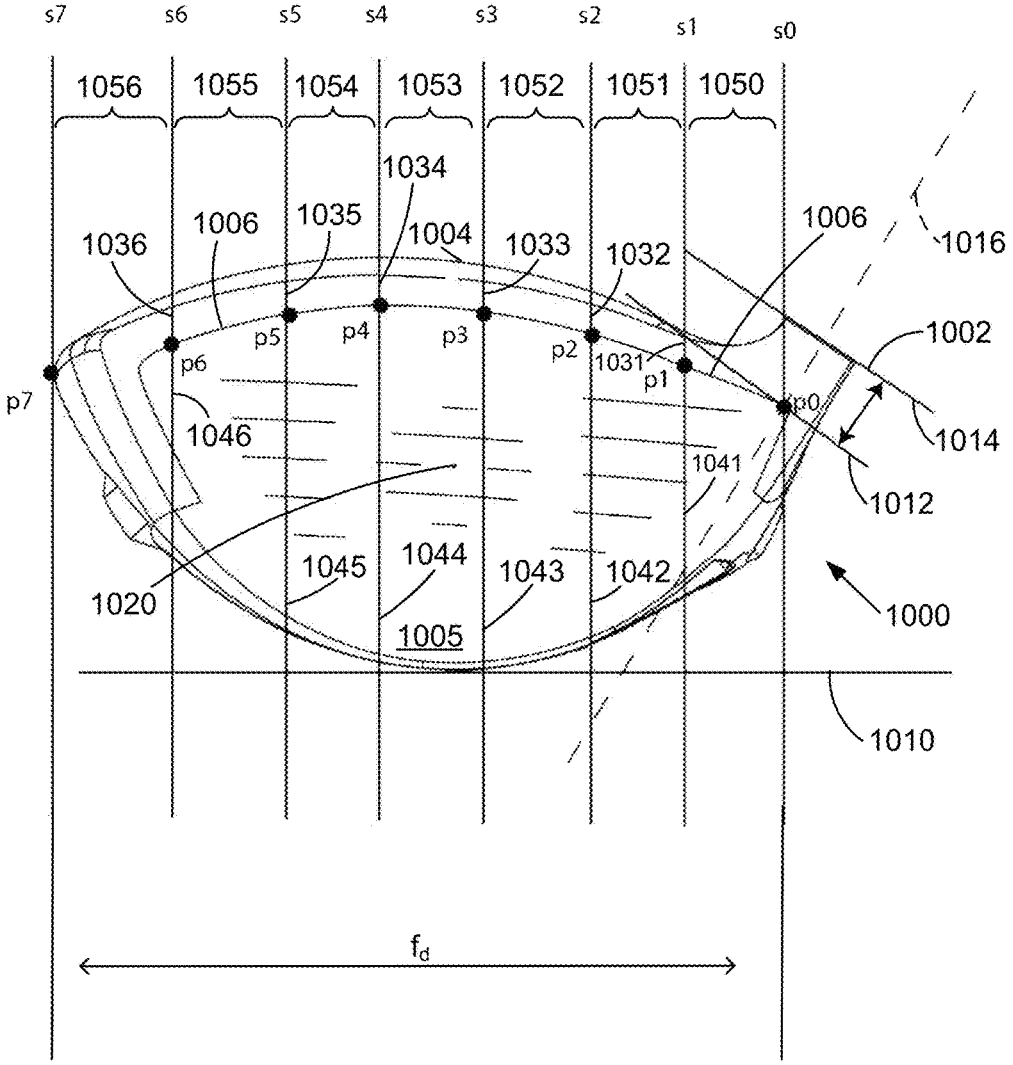
FIG. 22 is an elevational view of a representative contrast-enhanced wood-type club head.

With reference to FIG. 22, a representative club head 1000 includes a hosel end 1002, a crown 1004, and a striking face 1005. A top edge 1006 of the striking surface is adjacent a portion of the crown 1004 that is forward facing and defines an upper crown/striking face boundary. As shown in FIG. 22, the club head is situated in an address position with reference to a horizontal surface 1010. A second plane 1012 is parallel to a first plane 1014. The first plane 1014 is tangent to the hosel end 1002 and the second plane 1012 is offset towards the horizontal surface 1010 along a hosel axis 1016 by an offset distance of 15 mm. The hosel axis 1016 is contained within a hosel plane that is perpendicular to the horizontal surface 1010. In other words, the hosel plane is parallel to the page surface and contains the hosel axis 1016. The hosel axis 1016 and the second plane 1012 intersect at a first intersection point. A first vertical plane s0 is taken through the first intersection point p0. The first vertical plane s0 is perpendicular to the hosel plane. As shown in FIG. 10, the first intersection point p0 corresponds to an intersection of the first vertical plane s0, the second plane 1012, and the striking face 1005 surface. In other words, the first face intersection point p0 is contained within the striking face 1005, the second plane 1012, and the first vertical plane s0. A plurality of crown/striking face boundary points p1, . . . , p6 can be evenly or otherwise spaced along the top edge 1006 of the striking surface 1005. In some examples, such points are equidistant as measured along a horizontal direction parallel to the horizontal surface 1010. A point p7 identifies a most distant portion of the club head 1000 on the toe end of the club head 1000. A toe-end plane or seventh vertical plane s7 is defined to be tangent at the toe end point p7 and is perpendicular to the hosel plane.

With the first vertical plane s0 and the seventh vertical plane s7 defined as above, a face distance $f_d$ between the two planes s0, s7 is determined in a horizontal direction along the ground plane 1010. The face distance $f_d$ is evenly divided into seven horizontally equidistant regions by planes s1 . . . s6. As shown in FIG. 22, planes s0, . . . , s7 are defined as planes perpendicular to the hosel plane and the horizontal plane 1010 and contain points p0, . . . , p7 located on the striking surface 1005, respectively. Each dividing plane s1 . . . s6 contains a respective contrast point p1 . . . p6 located near the face to crown transition region. The contrast points p1 . . . p6 correspond to points on the face associated with color transitions from a dark color to a light color of the crown. A transition from a dark color to a light color can be defined as "high contrast" if the L* values between face and the crown differ by more than 50. In some embodiments, the L* values between the crown color and the face color differ by more than 60 or 65.

In some embodiments, the difference in L* values between the crown and the face is high contrast, as defined above, for more than about 14.3% of the face distance $f_d$ (at least one of the equidistant regions is high contrast). In other embodiments, the difference in L* values between the crown and the face is high contrast, as defined above, for more than about 28.6% of the face distance $f_d$ (at least two of the equidistant regions are high contrast). In other embodiments, the difference in L* values between the crown and the face is high contrast, as defined above, for more than about 42.9% of the face distance $f_d$ (at least three of the equidistant regions are high contrast). In other embodiments, the difference in L* values between the crown and the face is high contrast, as defined above, for more than about 57.1% of the face distance $f_d$ (at least four of the equidistant regions are high contrast). In other embodiments, the difference in L* values between the crown and the face is high contrast, as defined above, for more than about 71.4% of the face distance $f_d$ (at least five of the equidistant regions are high contrast). In other embodiments, the difference in L* values between the crown and the face is high contrast, as defined above, for more than about 85.7% of the face distance $f_d$ (at least six of the equidistant regions are high contrast). In other embodiments, the difference in L* values between the crown and the face is high contrast, as defined above, for more than about 99% of the face distance $f_d$ (at least six of the equidistant regions are high contrast along with a significant portion of the seventh equidistant region)

The equidistant regions of high contrast mentioned above can be contiguous across the face to crown transition or they can be spaced apart from one another in alternating or random fashion across the face to crown transition. In one embodiment, six out of the seven equidistant regions contain a high contrast crown to face transition across the entire horizontal distance (measured along $f_d$) within each region. In some embodiments, two, three, four, or five out of the seven equidistant regions contain a high contrast crown to face transition across the entire horizontal distance within each region.

In the view of FIG. 22, the planes s0, . . . s6 define respective projection crown lengths 1031-1036 and striking face projection lengths 1041-1046 that extend along the projections of the crown and the striking surface into the hosel plane (i.e., into a plane parallel to the drawing sheet. In typical examples, the crown 1004 is configured to be a white diffuser as described above, and the striking face 1005 is configured to be a dark or black diffuser with the exception of scorelines or striking face ornamentations. In representative examples, a set of such crown and striking face projection lengths includes projection lengths for which ratios of a striking face projection length to a corresponding crown projection length are in a range of from about 3:2 to about 10:1, and a set of evenly space projections includes ratios in this range, or ranges of 2:1 to 8:1 or 3:1 to 7:1.

Selected Putter Intensity Profiles and Colorations

Some representative putter intensity profiles, CIELab color values, and gloss data are provided below for contrast-enhanced putters as well as conventional putters. In some embodiments, putter top surfaces are painted, coated, or otherwise prepared to have color values similar to those associated with a golf ball. Representative CIELab values for golf balls are provided in Table 3 below.

TABLE 3

CIELab values for three types of golf balls having a white appearance.

| | Ball Identifier | | | | | | | | |
|---|---|---|---|---|---|---|---|---|---|
| | 1 | | | 2 | | | 3 | | |
| Illuminant | D65 | A | F2 | D65 | A | F2 | D65 | A | F2 |
| L* | 91.34 | 90.41 | 90.45 | 91.37 | 90.61 | 90.67 | 91.32 | 90.41 | 90.44 |
| a* | −1.78 | −3.18 | −0.77 | −1.91 | −2.82 | −0.85 | −1.81 | −3.15 | −0.82 |
| b* | −9.69 | −11.31 | −12.03 | −7.39 | −8.92 | −9.41 | −9.40 | −10.97 | −11.66 |
| C* | 9.86 | 11.75 | 12.05 | 7.63 | 9.36 | 9.45 | 9.57 | 11.42 | 11.69 |
| h | 259.57 | 254.30 | 266.32 | 255.54 | 252.48 | 264.86 | 259.08 | 253.98 | 265.97 |

CIELab values for various putter configurations are summarized in Tables 4-5. Table 4 contains data for conventional putters, and Table 5 contains data for contrast-enhanced putter heads similar in shape to the putter head of FIGS. 1A-1D.

TABLE 4

CIELab coordinates for selected conventional putters.

| | Putter Identifier | | | | | |
|---|---|---|---|---|---|---|
| | 14 | | | 27 | | |
| Illuminant | D65 | A | F2 | D65 | A | F2 |
| L* | 86.61 | 86.66 | 86.68 | 92.17 | 91.71 | 91.78 |
| a* | −1.04 | −0.36 | −0.66 | −2.25 | −2.44 | −1.53 |
| b* | 2.29 | 1.96 | 2.50 | −2.90 | −3.91 | −3.62 |
| C* | 2.52 | 1.99 | 2.59 | 3.68 | 4.61 | 3.93 |
| h | 114.42 | 100.52 | 104.89 | 232.18 | 237.97 | 247.12 |

TABLE 5

CIELab coordinates for selected contrast-enhanced putters.

| | Putter Identifier | | | | | | | | | | | |
|---|---|---|---|---|---|---|---|---|---|---|---|---|
| | 9 | | | 12 | | | 10 | | | 11 | | |
| Illuminant | D65 | A | F2 | D65 | A | F2 | D65 | A | F2 | D65 | A | F2 |
| L* | 64.37 | 64.35 | 64.38 | 89.33 | 88.95 | 89.02 | 91.68 | 91.21 | 91.25 | 24.61 | 24.55 | 24.58 |
| a* | −0.33 | −0.27 | −0.23 | −1.83 | −2.07 | −1.19 | −2.69 | −2.57 | −1.80 | −0.04 | −0.24 | −0.03 |
| b* | 0.36 | 0.30 | 0.43 | −2.43 | −3.23 | −2.97 | −2.24 | −3.35 | −2.92 | −0.72 | −0.76 | −0.81 |
| C* | 0.49 | 0.40 | 0.49 | 3.04 | 3.83 | 3.20 | 3.51 | 4.22 | 3.43 | 0.72 | 0.79 | 0.81 |
| h | 131.85 | 132.13 | 118.41 | 233.00 | 237.35 | 248.17 | 219.82 | 232.43 | 238.31 | 267.18 | 252.36 | 268.06 |

A top surface of Putter #10 is provided by a primer coating over which a base coat is applied. A top surface of Putter #12 is provided by a primer coating, followed by a base coating that is covered by a matte clear coat. Data for mechanically similar putter heads with a matte clear coat and a flat black coating are also provided in Table 5.

Figure 23:
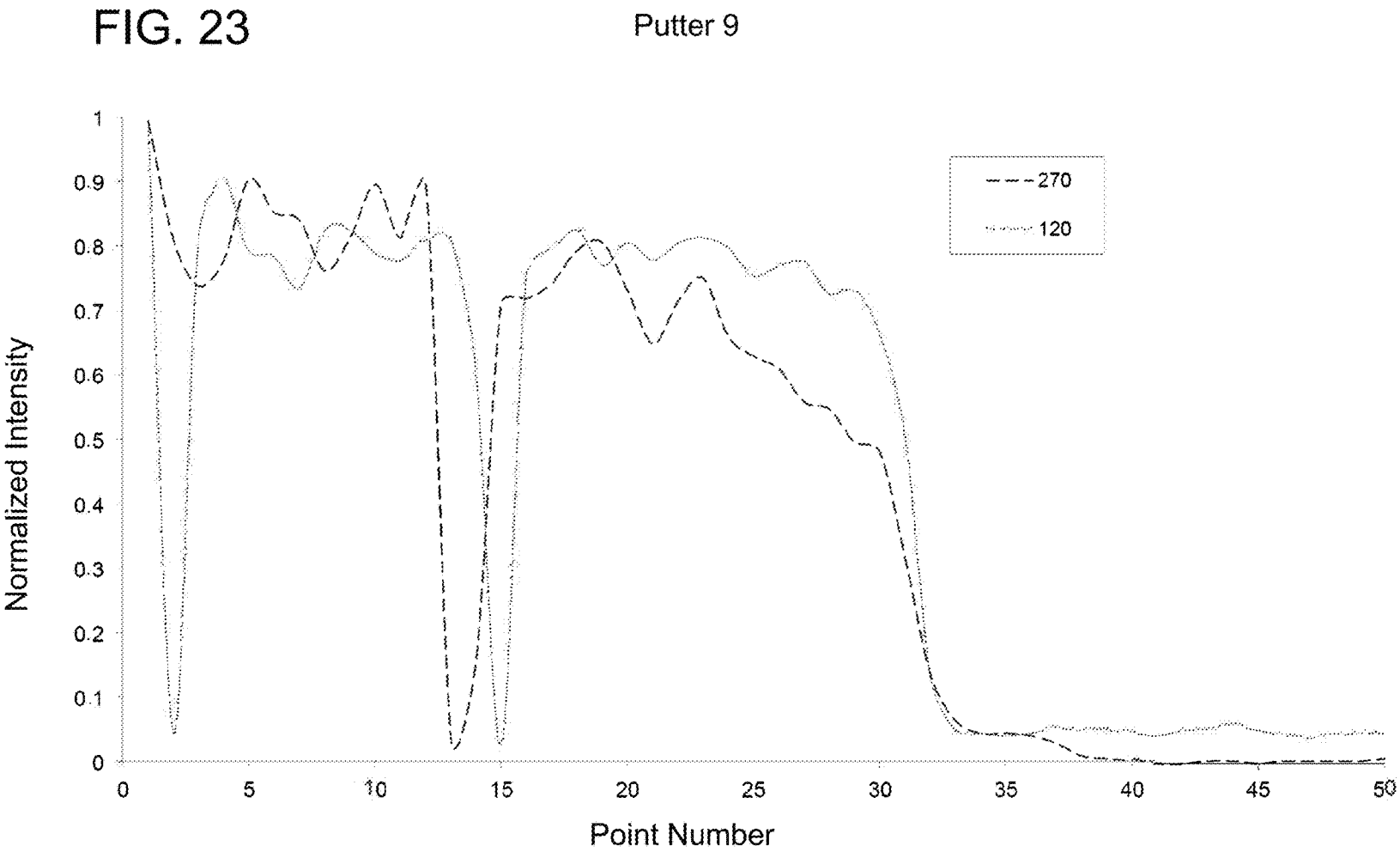
FIG. 23 is a graph illustrating measured top surface brightness along pixel radii at 120 degrees and 270 degrees for a putter head having a matte clear coat over a metallic surface.

FIG. 23 illustrates surface brightness along 120 degree and 270 degree radii for a putter head having a matte coating and a gray diffuse appearance (Putter #9). The dips in normalized intensity around point numbers 10-15 are due to black alignment grooves, and the intensity decrease at 270 degrees for point numbers 25 and larger appears to be associated with a putter head feature corresponding to the rear arc 116 shown in FIG. 1A. Over the remainder of the putter head top surface, surface brightness remains greater than about 70% of a maximum brightness.

Figure 24:
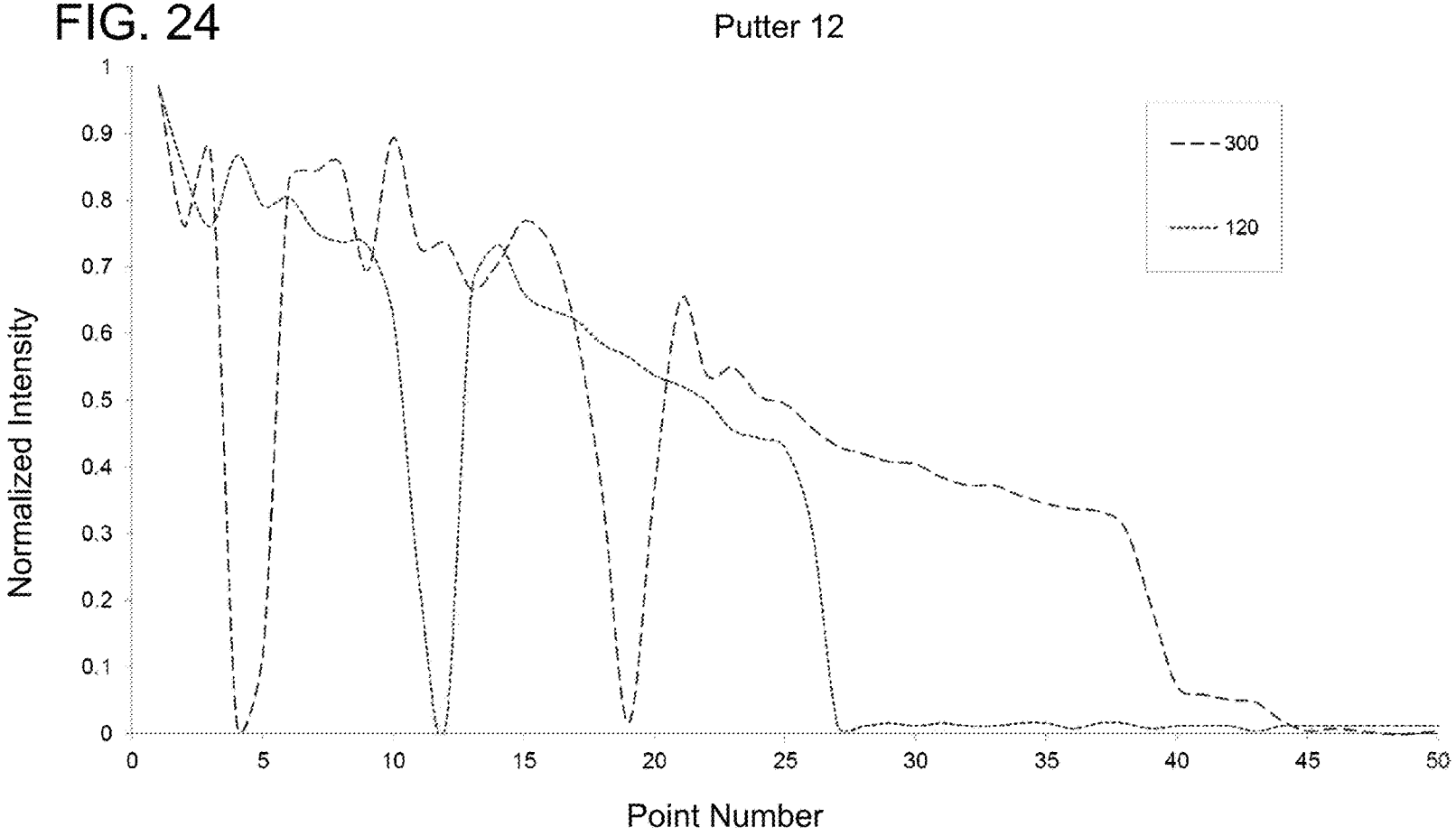
FIG. 24 is a graph illustrating measured top surface brightness along pixel radii at 120 degrees and 300 degrees for a putter head having a diffusing white top surface.
Figure 25:
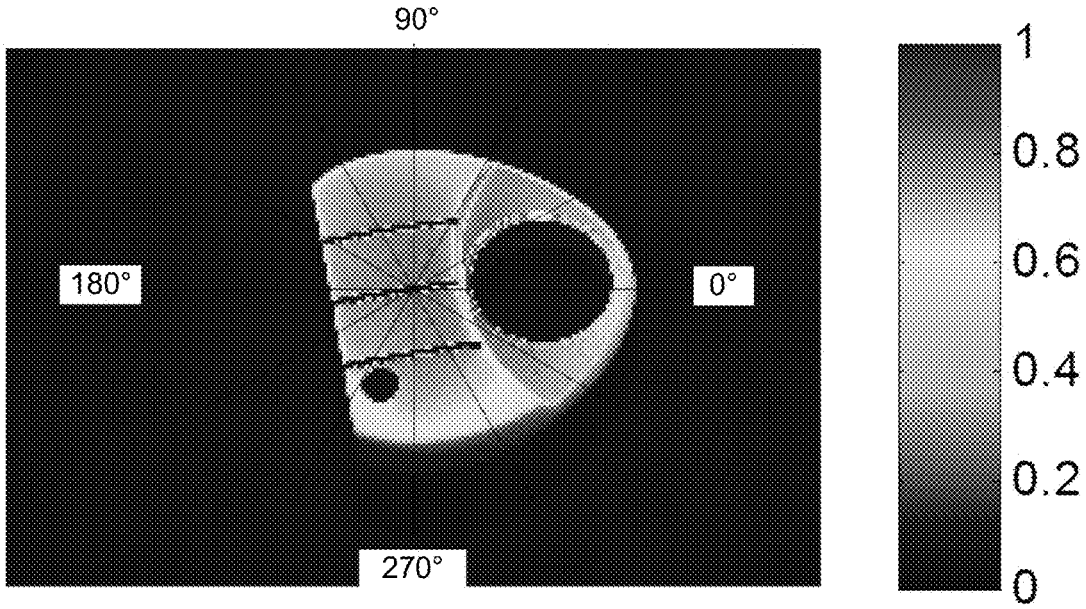
FIG. 25 illustrates selected equal intensity contours for the putter head associated with FIG. 24.

FIG. 24 illustrates surface brightness along 120 degree and 300 degree radii for a putter head having a white diffusing coating (Putter #12). The dips in normalized intensity around point numbers 4, 12, and 19 are due to black alignment grooves. Over the remainder of the putter head top surface, surface brightness remains greater than about 40% of a maximum brightness. FIG. 25 illustrates corresponding representative surface brightness contours and radii orientations. The contours of FIG. 25 are shown without the surface brightness decreases in the alignment grooves.

Figure 26:
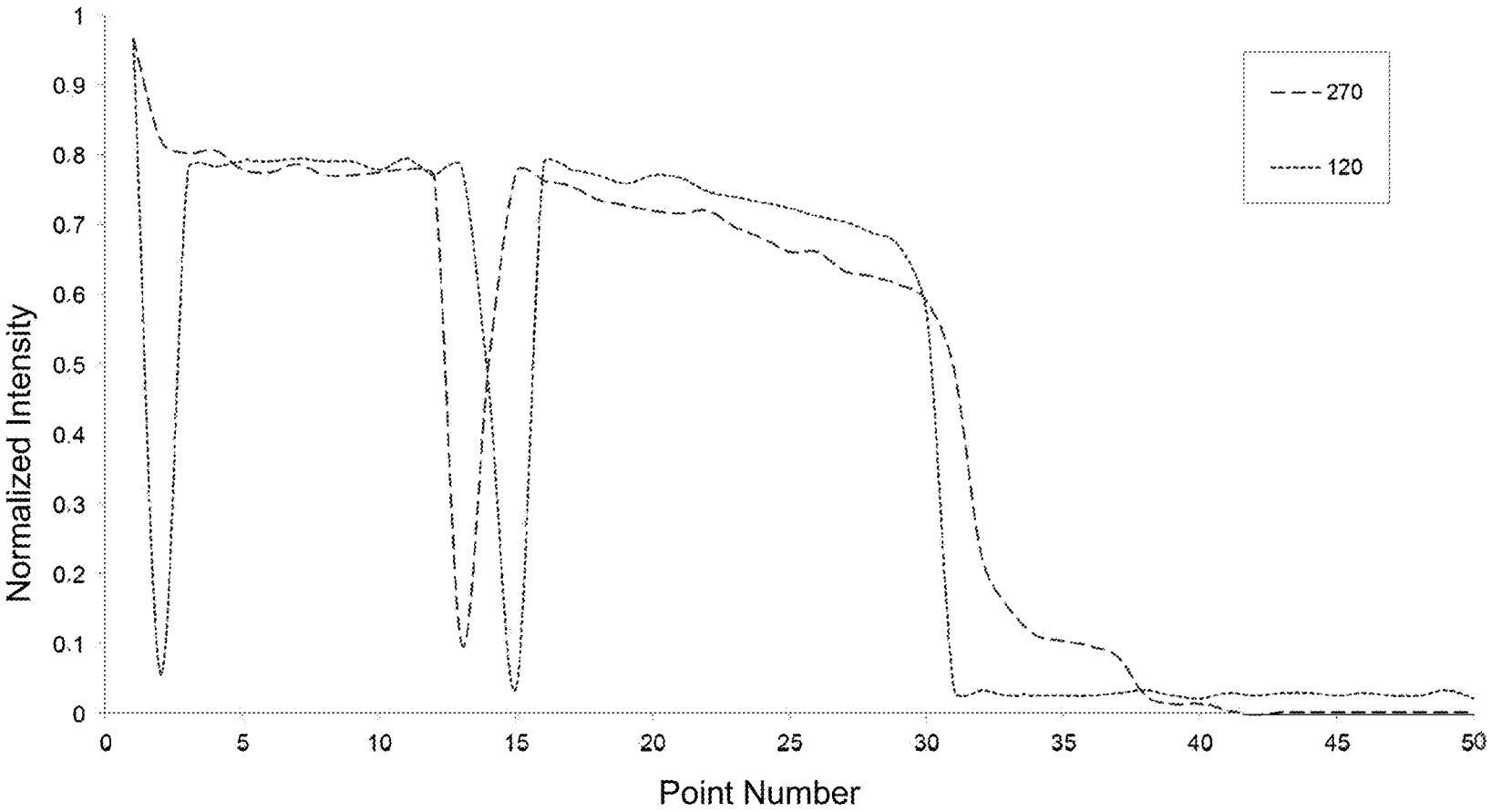
FIG. 26 is a graph illustrating measured top surface brightness along pixel radii at 120 degrees and 300 degrees for a putter head having a diffusing white top surface.

FIG. 26 illustrates surface brightness along 120 degree and 270 degree radii for a putter head having a white diffusing coating (Putter #10). The dips in normalized intensity around point numbers 2 and 15 are due to black alignment grooves. Over the remainder of the putter head top surface, surface brightness remains greater than about 65% of a maximum brightness.

The thickness of the paint coating can vary based on the type of material being painted. For example, in one embodiment, a steel body is painted with a primer layer and white paint layer having a combined thickness of about 45-60 m and a clear coat layer of about 50-60 μm. In another embodiment, an aluminum body is painted with a primer layer and a white paint layer having a combined thickness of about 25-40 μm and a clear coat layer of about 30-40 μm.

Figure 27:
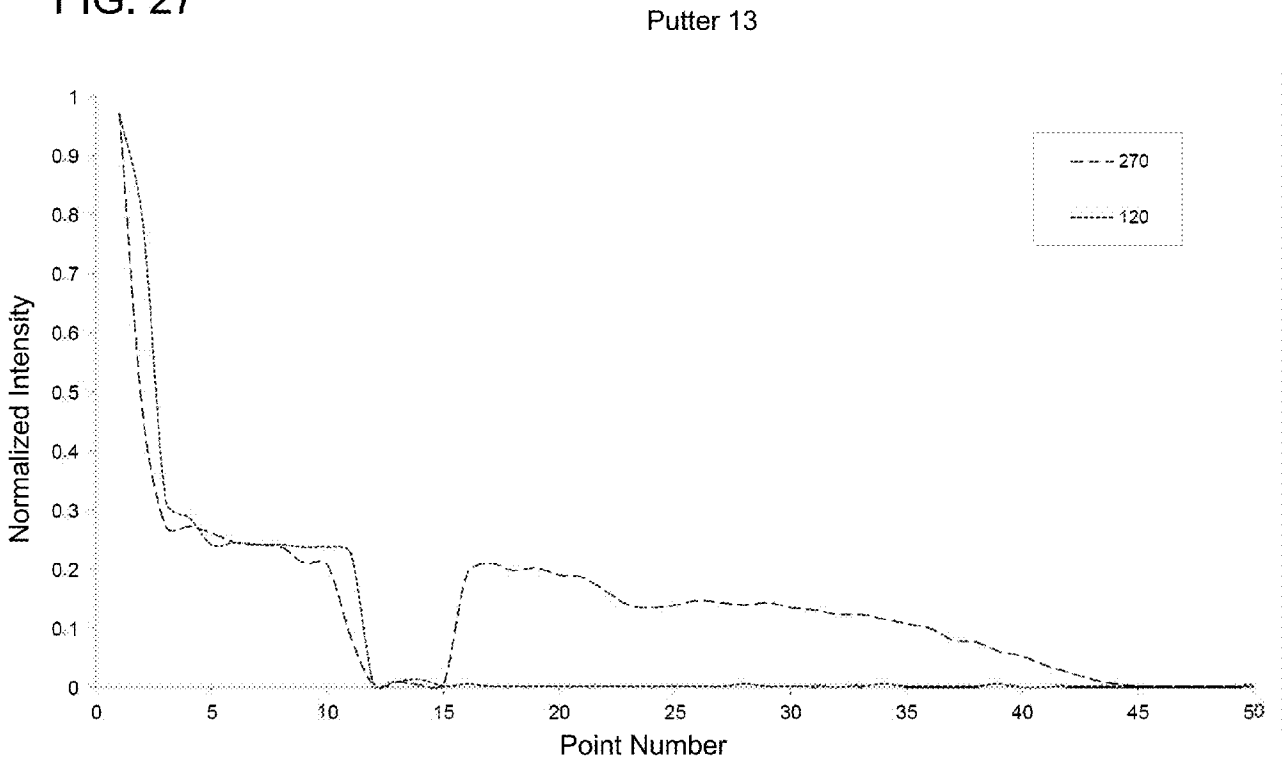
FIG. 27 is a graph illustrating measured top surface brightness along pixel radii at 120 degrees and 270 degrees for a conventional putter head.

FIG. 27 illustrates surface brightness along 120 degree and 270 degree radii for a conventional putter head (Putter #13). The dip in normalized intensity around point number 14 is associated with club head markings. The surface brightness varies widely, and drops to less than 35% of a maximum value over only about 4 points, and remains less than about 25-30% of a maximum value over a substantial portion of the surface. Such a brightness curve is indicative of a pronounced hot spot.

Figure 28:
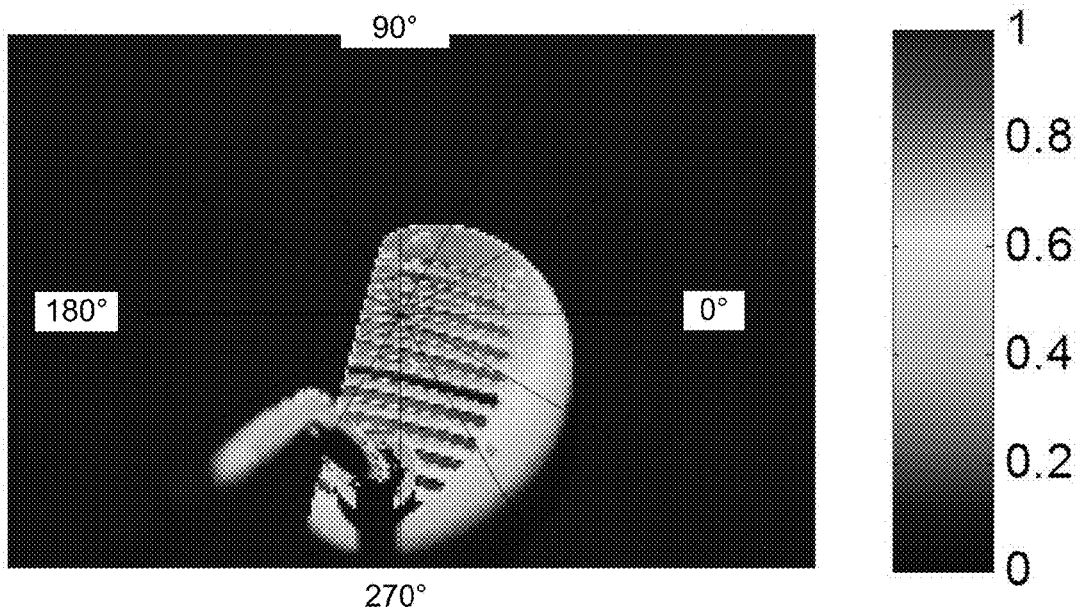
FIG. 28 illustrates selected equal intensity contours for the putter head associated with FIG. 29.
Figure 29:
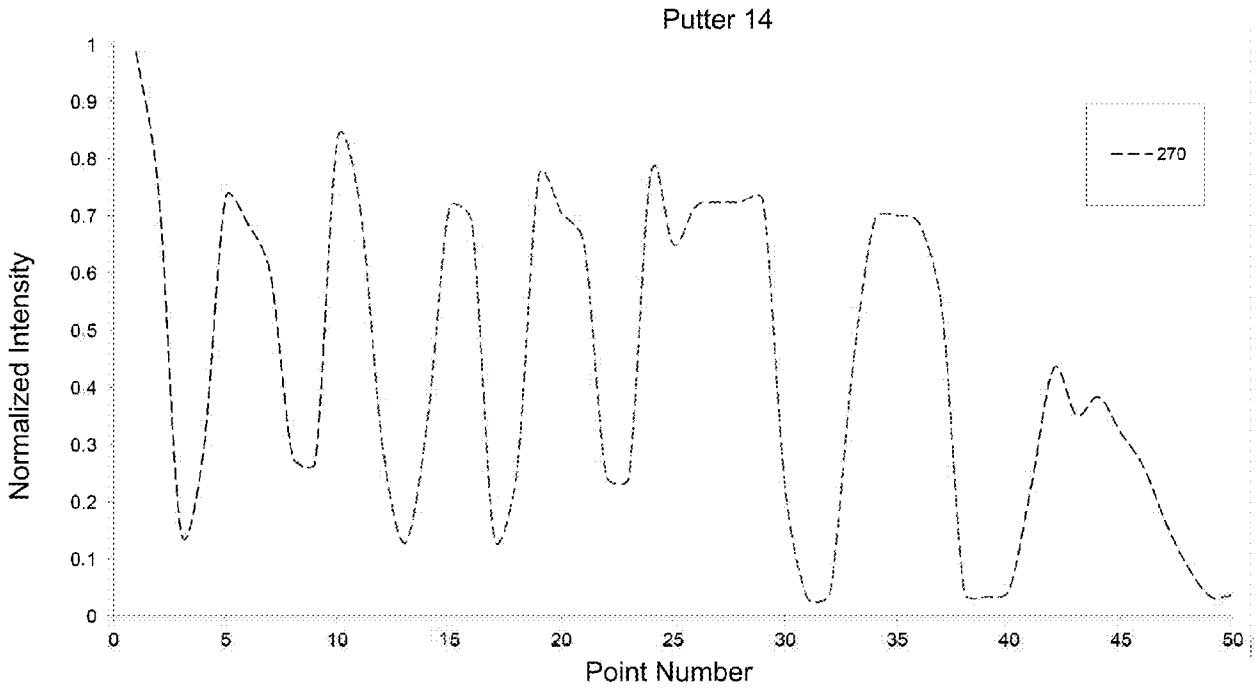
FIG. 29 is a graph illustrating measured surface brightness along a radius at 270 degrees for a conventional putter head.

FIG. 28 is a top perspective view of another conventional putter head 1100 (Putter #14) and FIG. 29 is a graph of surface brightness. This putter head 1100 includes a set of periodic grooves such a groove 1102 and the associated surface brightness drops periodically to near zero as a result, resulting in a reduced apparent intensity when viewed by a golfer. Brightness contour lines are shown in FIG. 28 absent the drop offs associated with the grooves.

The above describes only representative examples with reference to the shortcomings of conventional club heads. Embodiments of the disclosed club heads can provide high contrast and high visibility with respect to typical backgrounds against which a club head is viewed. For example, bright white (such as color neutral surfaces with CIELab L* of greater than 75 and less than 100, a chroma of less than 2) provides superior contrast with respect to grass playing surfaces. In addition, providing a diffusely reflecting surface such as a semigloss surface with a gloss of less than about 60 gloss units, visually distracting hot spots can be eliminated or reduced. In combination with bright white, such a surface appears to have a uniform high brightness to a golfer. Finally, a club face that contrast with a bright white upper surface provides a high face/crown contrast that can be used for shot alignment. However, it will be appreciated that there are many club head variations that offer some or all of these advantages, and the claims are not to be limited so as to require any or all of these advantages. Therefore, we claim all that is encompassed by the appended claims.

We claim:

1. A metal wood-type golf club head comprising: a body comprising a face plate positioned at a forward portion of the golf club head, a sole positioned at a bottom portion of the golf club head, a crown positioned at a top portion of the golf club head and a skirt positioned around a periphery of the golf club head between the sole and the crown; wherein the golf club head has a golf club head origin positioned on the face plate at an approximate geometric center of the face plate, the golf club head origin including an x-axis tangential to the face plate and generally parallel to the ground when the golf club head is in an address position, a y-axis generally perpendicular to the x-axis and generally parallel to the ground when the golf club head is in an address position, and a z-axis generally perpendicular to the x-axis and to the y-axis and generally perpendicular to the ground when the golf club head is in an address position, wherein a positive x-axis extends toward a golf club head heel, a positive y-axis extends toward a rearward portion of the golf club head, and a positive z-axis extends away from the ground with the golf club head in the address position, wherein at least a perimeter portion of the crown adjacent a top portion of the face plate and having an area that is at least 5% of a crown area has a bright, diffusely reflecting surface, and at least a top perimeter portion of the face plate has a dark, diffusely reflecting surface area, wherein at least the top perimeter portion of the face plate and the perimeter portion of the crown each has a gloss value less than about 60 gloss units, wherein the gloss value is associated with a reflected light at an angle of reflection of 60 degrees in response to an incident light directed to the top portion of the face plate or the perimeter portion of the crown at an angle of incidence of 60 degrees, and the top portion of the face plate and perimeter portion of the crown have a brightness difference of at least 40, and wherein, with an illumination source placed directly above the golf club head and a sensor placed so that an angle between an axis of illumination and a line from the golf club head to the sensor is about 41 degrees, a maximum reflected light intensity is detected at the sensor from a first golf club head location, and the reflected light intensity detected at the sensor from each of a plurality of points on the top portion of the golf club head that are situated more than one quarter of the distance and less than three quarters of the distance from the first golf club head location to a golf club head perimeter portion exceeds half the maximum reflected light intensity.

2. The golf club head of claim 1, wherein the bright, diffusely reflecting surface of the crown is white and includes at least an upper facing portion of the crown, and a face plate surface is a dark, diffusely reflecting surface.

3. The golf club head of claim 1, wherein the bright, diffusely reflecting surface of the crown has a chroma value of less than 5, and a face plate surface has a chroma value of less than 1.

4. The golf club head of claim 3, wherein the bright, diffusely reflecting surface of the crown has a brightness of at least 80.

5. The golf club head of claim 1, wherein at least a portion of the crown adjacent the top perimeter portion of the face plate has a semigloss surface with a chroma value of less than 10 and a brightness of at least 50.

6. The golf club head of claim 1, wherein the bright, diffusely reflecting surface extends over at least 80% of an upward facing crown area.

7. The golf club head of claim 1, wherein a crown surface has a CIELab brightness of between 50 and 100, and a gloss value of less than 60 gloss units.

8. The golf club head of claim 7, wherein the dark, diffusively reflecting face plate surface has a CIELab brightness of less than 40 and a chroma of less than 10.

9. The golf club head of claim 1, wherein the face plate has a gloss value of less than 60 gloss units.

10. The golf club head of claim 1, wherein a difference in L* values between the crown and the face plate is high contrast for more than about 14.3% of a face distance.

11. The golf club head of claim 1, wherein a difference in L* values between the crown and the face plate is high contrast for more than about 28.6% of a face distance.

12. The golf club head of claim 1, wherein a difference in L* values between the crown and the face plate is high contrast for more than about 42.9% of a face distance.

13. The golf club head of claim 1, wherein a difference in L* values between the crown and the face plate is high contrast for more than about 57.1% of a face distance.

14. The golf club head of claim 1, wherein a difference in L* values between the crown and the face plate is high contrast for more than about 71.4% of a face distance.

15. The golf club head of claim 1, wherein a difference in L* values between the crown and the face plate is high contrast, as defined above, for more than about 85.7% of a face distance.

16. The metal wood-type golf club head of claim 1, wherein the plurality of points lie more than one half of the distance and less than three quarters of the distance from the first golf club head location to the golf club head perimeter portion.

17. The metal wood-type golf club head of claim 1, wherein the plurality of points comprises all points on the top portion of the golf club head that lie more than one quarter of the distance and less than one half of the distance from the first golf club head location to a golf club head perimeter portion.

18. A metal wood-type golf club head comprising: a body comprising a face plate positioned at a forward portion of the golf club head, a sole positioned at a bottom portion of the golf club head, a crown positioned at a top portion of the golf club head and a skirt positioned around a periphery of the golf club head between the sole and the crown; wherein the golf club head has a golf club head origin positioned on the face plate at an approximate geometric center of the face plate, the golf club head origin including an x-axis tangential to the face plate and generally parallel to the ground when the golf club head is in an address position, a y-axis generally perpendicular to the x-axis and generally parallel to the ground when the golf club head is in an address position, and a z-axis generally perpendicular to the x-axis and to the y-axis and generally perpendicular to the ground when the golf club head is in an address position, wherein a positive x-axis extends toward a golf club head heel, a positive y-axis extends toward a rearward portion of the golf club head, and a positive z-axis extends away from the ground with the golf club head in the address position, wherein at least a perimeter portion of the crown adjacent a top portion of the faceplate and having an area that is at least 5% of a crown area has a bright, effective diffusing surface, and at least a top perimeter portion of the face plate has a dark, effective diffusing surface, wherein the bright, effective diffusing surface and the dark, effective diffusing surface have effective diffusing ratios of at least 0.6 at an angle of 45 degrees.

* * * * *